US005222451A

United States Patent [19]

Akahane et al.

[11] Patent Number: 5,222,451

[45] Date of Patent: Jun. 29, 1993

[54] METHOD OF POSITIONING AND FEEDING FABRIC IN SEWING MACHINE

[75] Inventors: Kohichi Akahane, Komaki; Etsuzo Nomura, Kasugai; Hirosumi Ito, Nagoya; Hirokazu Takeuchi, Chita, all of Japan

[73] Assignee: Brother Kogyo Kabushiki Kaisha, Nagoya, Japan

[21] Appl. No.: 836,730

[22] Filed: Feb. 19, 1992

[30] Foreign Application Priority Data

Feb. 19, 1991 [JP] Japan ..... 3-47548

[51] Int. Cl.[5] ..... D05B 21/00

[52] U.S. Cl. ..... 112/262.3; 271/227

[58] Field of Search ..... 112/121.12, 262.3, 306, 112/121.11, 314, 320; 271/227

[56] References Cited

U.S. PATENT DOCUMENTS 4,834,008 5/1989 Sadeh et al. ..... 112/121.12
4,901,659 2/1990 Nomura et al. ..... 112/121.11 X
4,901,660 2/1990 Takeuchi et al. ..... 112/121.11 X
5,131,339 7/1992 Goodridge ..... 112/121.12 X

*Primary Examiner*—Peter Nerbun
*Attorney, Agent, or Firm*—Oliff & Berridge

[57] ABSTRACT

A fabric position correcting device detects the position of at least one of an outer profile line and a pattern of a fabric portion corresponding to one of pressers, corrects the position of the fabric portion while holding the same whose position has been detected, and presses the fabric portion with the presser after the position thereof has been corrected. The aligning process composed of the above three steps is carried out four times successively with respect to fabric portions corresponding to the respective pressers from the leading end of the fabric in the direction in which it is fed. Then, the positionally corrected fabrics are fed to the sewing start position. Therefore, the positional correction of the fabrics relative to at least one of the outer profile line and the pattern thereof can be accurately, reliably, and automatically carried out from the leading end to trailing end of the fabrics.

11 Claims, 23 Drawing Sheets

FIG. 21
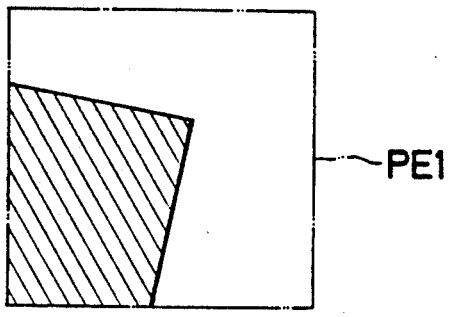
FIG. 22
| | | |
|---|---|---|
| 0 | 1 | 0 |
| 1 | −4 | 1 |
| 0 | 1 | 0 |
FIG. 23
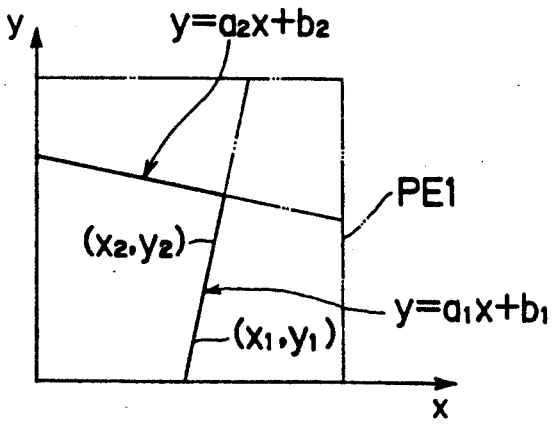

METHOD OF POSITIONING AND FEEDING FABRIC IN SEWING MACHINE

BACKGROUND OF THE INVENTION

1. Field of the Invention

The present invention relates to a method of positioning and feeding a fabric in a sewing machine, and more particularly to a method composed of the steps of detecting the position of at least one of an outer profile line and a pattern of a fabric portion corresponding to one of pressers, correcting the position of the fabric portion while holding the same whose position has been detected, and pressing the fabric portion with the presser after the position thereof has been corrected, the steps being carried out successively with respect to fabric portions corresponding to respective pressers from the leading end of the fabric in the direction in which it is fed, and followed by the feeding of the fabrics to a sewing start position.

2. Description of the Prior Art

There have been proposed various fabric positioning and feeding techniques for positionally correcting an edge of a fabric to be sewn, from a leading end to a trailing end thereof, and feeding the positionally corrected fabric to a sewing start position.

For example, Japanese Patent Publication No. 52-45987 discloses one such fabric positioning and feeding technique. Specifically, the disclosed apparatus includes a clamp mechanism having first, second, and third slide plates, servomotors, and other members for pressing a plurality of presser rods against a fabric support base, a guide mechanism having a plurality of fabric holder rods, fabric engaging members, guide rods, and other members for positioning an edge of a fabric, and a drive mechanism for moving the clamp mechanism to a sewing start position. In operation, the presser rods are positionally adjusted into abutment against the edge of the fabric that is placed on the fabric support base, and the guide rods are also positionally adjusted to arrange the fabric engaging members, which are mounted on the distal ends of the guide rods, into a shape corresponding to the fabric edge. Thereafter, the fabric is positioned along the fabric engaging members that have been moved for a sewing margin, and the positioned fabric is clamped by the clamp mechanism, after which the fabric is fed to the sewing start position.

According to the disclosed process, however, the operator is required to adjust the positions of the presser rods and the guide rods to a pattern along the edge of the fabric while taking the sewing margin into account, in order to position the fabric to be sewn. Therefore, the positional adjustments puts a relatively large burden on the operator, and the fabric cannot be positioned with respect to a pattern thereon.

SUMMARY OF THE INVENTION

It is an object of the present invention to provide a method of accurately, reliably, and automatically adjusting the position of a fabric with respect to at least one of an outer profile line thereof and a pattern thereon, from one end to the other of the fabric in a direction in which the fabric is fed, and then feeding the fabric to a sewing start position in a sewing machine.

According to the present invention, there is provided a method of positioning and feeding a fabric with pressing and feeding means for feeding a fabric, to a sewing machine having a bed, on a support base disposed at substantially the same level as the bed and upstream with respect to a direction in which the fabric is fed, while the fabric is being pressed against the support base with a plurality of independently actuatable pressers spaced at intervals in the direction, position detecting means, including imaging means for successively imaging a plurality of portions of the fabric which correspond to the pressers, for detecting the position of at least one of an outer profile line and a pattern of each of the portions of the fabric based on image data produced by the imaging means, and position correcting means for correcting the position of each of the portions of the fabric that have been detected, while the portions of the fabric are being successively held in position, the method comprising the steps of: (a) detecting the position of each of the portions of the fabric corresponding to one of the pressers, with the position detecting means; (b) correcting the position of the portion of the fabric while holding the same whose position has been detected, with the position correcting means; (c) pressing the portion of the fabric with one of the pressers after the position thereof has been corrected; (d) repeating the steps (a), (b), and (c) successively with respect to the portions of the fabric; and (e) feeding the fabric to a sewing start position with the pressing and feeding means.

Since the positional detection with the position detecting means, the positional correction with the position correcting means, and the pressing of the fabric with the presser are repeated successively with respect to the portions of the fabric, the positional correction of the fabric with respect to at least one of the outer profile line and the pattern thereof can be automatically, accurately, and efficiently carried out from one end to the other of the fabric in the direction in which it is fed. Furthermore, the pattern of the fabric can also be detected in addition to the outer profile line, and the fabric can be positionally corrected with reference to the detected pattern. The method of the present invention is accordingly practical and versatile. After the position of the fabric has been corrected, the fabric is fed to the sewing start position by the pressing and feeding means. As a result, the reference time required from the positional correction of the fabric to the start of a sewing operation of the fabric is shortened for high productivity.

The method further includes the step of feeding the fabric with the pressing and feeding means in synchronism with feeding of the fabric in the sewing machine, after the fabric starts being sewn by the sewing machine.

Since the fabric is fed in synchronism with feeding of the fabric in the sewing machine after it starts being sewn by the sewing machine, any positional error of the fabric during the sewing operation is reliably prevented, and the positional correction of the fabric and the sewing operation thereof are automatized in a successive process.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 21 is a diagram showing image data converted into binary data;

FIG. 22 is a diagram of a Laplacian filter;

FIG. 23 is a diagram showing the manner in which two outer profile lines at a corner of a fabric are determined;

DETAILED DESCRIPTION OF THE PREFERRED EMBODIMENTS

In the illustrated embodiment, the present invention is applied to a method of positioning and feeding two fabrics with the same pattern (striped pattern) drawn thereon such that the fabrics can be sewn by a sewing machine, while they are being aligned along their outer profile lines or the pattern by a fabric position correcting device.

Figure 1:
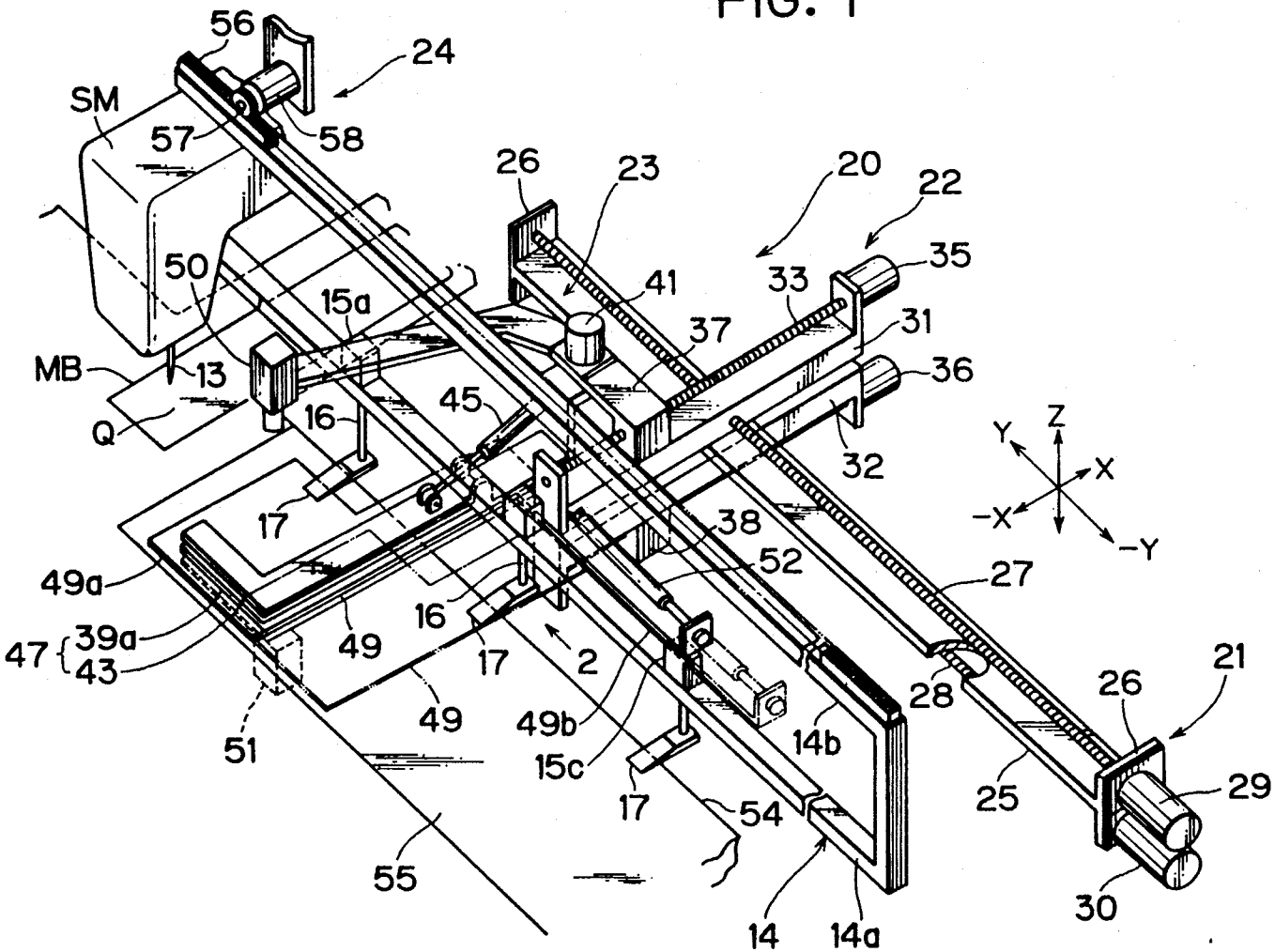
FIG. 1 is a perspective view of a fabric position correcting device.

First, a lock-stitch sewing machine SM for sewing fabrics will be described below. The lock-stitch sewing machine is a general sewing machine having a needle thread takeup lever actuating mechanism which is actuated by a sewing machine spindle rotated by a sewing machine motor 10, a needle bar actuating mechanism for actuating a needle bar vertically, a feed dog actuating mechanism, a thread loop catcher, and an automatic thread cutter. The sewing machine SM also has feed dogs that can be moved back and forth by a stepping motor through feed dog moving mechanisms. The sewing machine SM also has a presser bar with a presser foot mounted on the lower end thereof. The presser bar is movable by a solenoid 11 (see FIG. 3) between a pressing position in which the presser foot presses a fabric and an elevated position. When the needle bar is in an operative position, a needle position sensor 12 (see FIG. 3) which may comprise a photosensor, for example, produces an operative position signal. In FIG. 1, a sewing needle 13 is mounted on the lower end of the needle bar, and is positioned over a bed MB where the sewing needle 13 descends at a position Q.

A fabric position correcting device 20 disposed in front of the sewing machine SM will be described below with reference to FIGS. 1 and 2.

The fabric position correcting device 20 comprises a Y-direction actuating mechanism 21 for moving fabrics W1, W2 in a Y direction (back and forth) in a horizontal XY plane, an X-direction actuating mechanism 22 for moving the fabrics W1, W2 in an X direction (lateral) normal to the Y direction, and an angularly actuating mechanism 23 for angularly moving the fabrics W1, W2 horizontally about a vertical shape parallel to a Z direction (vertical) normal to the X and Y directions, through holders 47, 48 (described later on). These mechanisms 21 to 23 will be described below.

A support base 25 having a certain width is horizontally supported on a machine frame (not shown) in front of the sewing machine SM, the support base 25 extending in the Y direction. Side plates 26 are attached to the front and rear ends, respectively, of the support base 25. A first Y-direction ball screw shaft (hereinafter referred to as a "first Y-direction shaft") 27 is mounted on the upper side of the support base 25 and extends parallel thereto. A second Y-direction ball screw shaft (hereinafter referred to as a "second Y-direction shaft") 28 is mounted on the lower side of the support base 25 and extends parallel thereto. The Y-direction shafts 27, 28 are rotatably supported at their front and rear ends on the side plates 26. To the front side plate 26, there are fixed a first Y-direction drive motor (hereinafter referred to as a "first Y motor") 29 and a second Y-direction drive motor (hereinafter referred to as a "second Y motor") 30. The first Y motor 29 has a drive shaft coupled to the first Y-direction shaft 27, and the second Y motor 30 has a drive shaft coupled to the second Y-direction shaft 28. The motors 29, 30 comprise stepping motors, respectively.

The first Y-direction shaft 27 is threaded through a ball screw nut in a proximal end portion of a first Y-direction movable base 31 that is slidably held against the upper surface of the support base 25 and extends in the X direction. The second Y-direction shaft 28 is threaded through a ball screw nut in a proximal end portion of a second Y-direction movable base 32 that is slidably held against the lower surface of the support base 25 and extends in the X direction. When the first Y motor 29 is energized to rotate the first Y-direction shaft 27 about its own axis, the first Y-direction movable base 31 moves back and forth. Similarly, when the second Y motor 30 is energized to rotate the second Y-direction shaft 28 about its own axis, the second Y-direction movable base 32 moves back and forth.

A first X-direction ball screw shaft (hereinafter referred to as a "first X-direction shaft") 33 is mounted on the first Y-direction movable base 31 and extends parallel thereto. The first X-direction shaft 33 is rotatably supported at its lefthand and righthand ends on lefthand and righthand side walls of the first Y-direction movable base 31. A second X-direction ball screw shaft (hereinafter referred to as a "second X-direction shaft") 34 is mounted on the second Y-direction movable base 32 and extends parallel thereto. The second X-direction shaft 34 is rotatably supported at its lefthand and righthand ends on lefthand and righthand side walls of the second Y-direction movable base 32. A first X-direction drive motor (hereinafter referred to as a "first X motor") 35 is fixed to one of the side walls of the first Y-direction movable base 31, and a second X-direction drive motor (hereinafter referred to as a "second X motor") 36 is fixed to one of the side walls of the second Y-direction movable base 32. The first X motor 35 has a drive shaft coupled to the first X-direction shaft 33, and the second X motor 36 has a drive shaft coupled to the second X-direction shaft 34. The motors 35, 36 comprise stepping motors, respectively.

The first X-direction shaft 33 is threaded through a ball screw nut in a front end portion of a first X-direction movable base 37 that is slidably held against the upper surface of the first Y-direction movable base 31 and extends in the Y direction. The second X-direction shaft 34 is threaded through a ball screw nut in a front end portion of a second X-direction movable base 38 that is slidably held against the lower surface of the second Y-direction movable base 32 and extends in the Y direction. When the first X motor 35 is energized to rotate the first X-direction shaft 33 about its own axis, the first X-direction movable base 37 moves laterally in the X direction. Similarly, when the second X motor 36 is energized to rotate the second X-direction shaft 34 about its own axis, the second X-direction movable base 38 moves laterally in the X direction. As shown in FIGS. 1 and 2, a first turn arm 39 that extends to the left as a crank, for holding the upper fabric W1 is horizontally angularly movably mounted at a proximal end thereof on a rear end portion of the first X-direction movable base 37. A second turn arm 40 that extends to the left as a crank, for holding the lower fabric W2 is horizontally angularly movably mounted at a proximal end thereof on a rear end portion of the second X-direction movable base 38. The first turn arm 39 is angularly movable by a first turn motor 41 fixedly mounted on the rear end portion of the first X-direction movable base 37, and the second turn arm 40 is angularly movable by a second turn motor 42 fixedly mounted on the rear end portion of the second X-direction movable base 38. The turn arms 39, 40 have respective first and second holder members **39*a*, 40*a* bent horizontally rearwardly from their distal ends for reliably holding the upper and lower fabrics W1, W2. Therefore, when the first turn motor 41 is energized, the first turn arm 39 is angularly moved about the drive shaft of the first turn motor 41. When the second turn motor 42 is energized, the second turn arm 40 is angularly moved about the drive shaft of the second turn motor 42. The motors 41, 42** comprise stepping motors, respectively.

Figure 2:
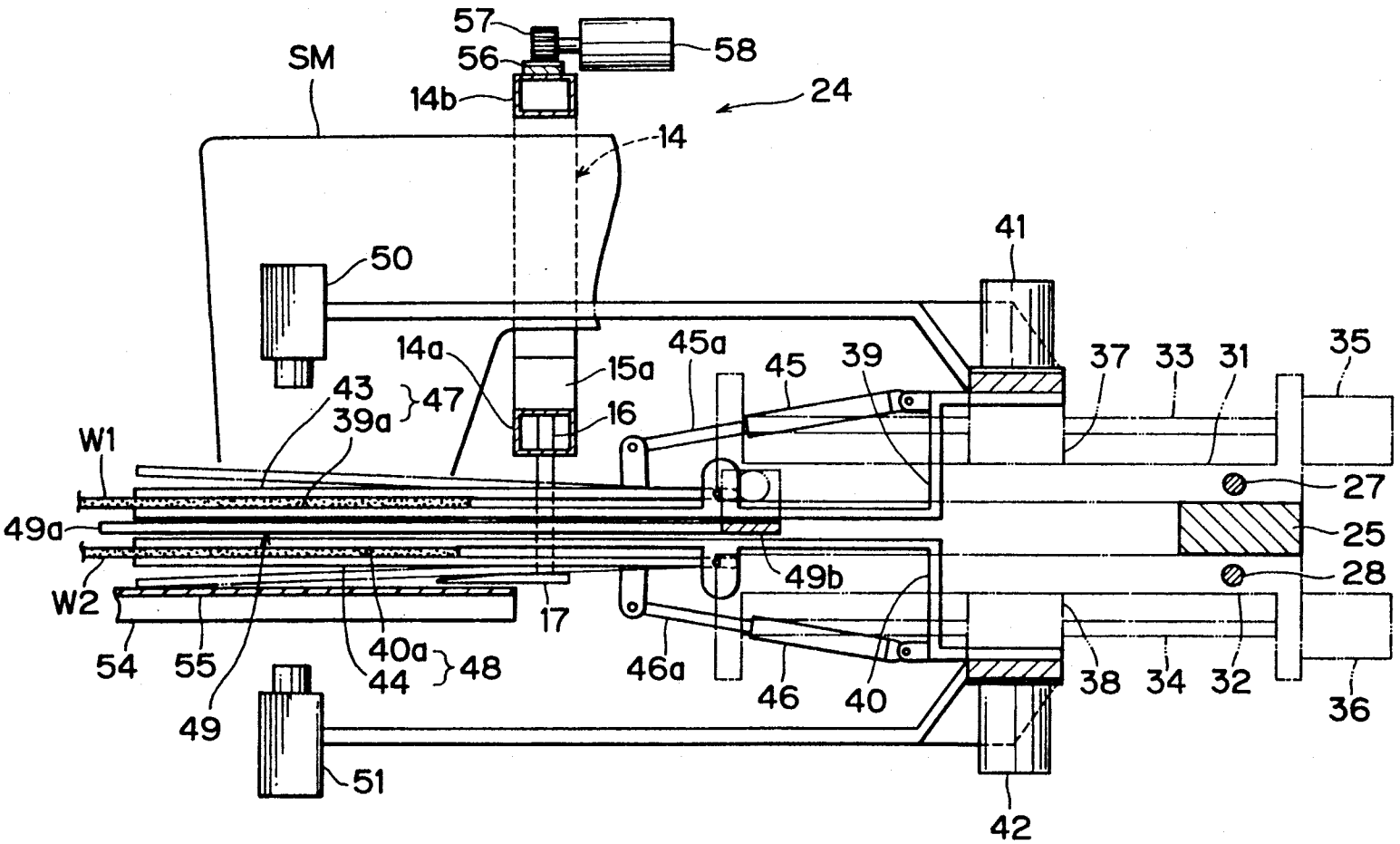
FIG. 2 is a view as viewed in the direction indicated by the arrow 2 in FIG. 1.

As shown in FIGS. 1 and 2, a first holding member 43 which is L-shaped in plan is disposed on the upper side of the first holder member **39*a*. The first holding member 43 is pivotally mounted at its righthand end for vertical swinging movement between a clamp position indicated by the solid line and an angularly moved position indicated by the two-dot-and-dash line. Likewise, a second holding member 44 which is L-shaped in plan is disposed on the lower side of the second holder member 40*a*. The second holding member 44 is pivotally mounted at its righthand end for vertical swinging movement between a clamp position indicated by the solid line and an angularly moved position indicated by the two-dot-and-dash line. A first air cylinder 45 is operatively coupled between the first turn arm 39 and the first holding member 43 for angularly moving the first holding member 43, and a second air cylinder 46 is operatively coupled between the second turn arm 40 and the second holding member 44 for angularly moving the second holding member 44. The first holder member 39*a* and the first holding member 43 jointly serve as a first holder 47 for clamping the upper fabric W1, and the second holder member 40*a* and the second holding member 44 jointly serve as a second holder 48 for clamping the lower fabric W2. The holders 47, 48** are independently movable in the X and Y directions in the horizontal XY plane, and also angularly movable about a vertical axis.

As shown in FIG. 2, the first air cylinder 45 has a piston rod **45*a* which, when projected, moves the first holding member 43 into the clamp position in which the fabric W1 is reliably clamped by the first holder 47. Likewise, the second air cylinder 46 has a piston rod 46*a* which, when projected, moves the second holding member 44 into the clamp position in which the fabric W2 is reliably clamped by the second holder 48**.

As shown in FIGS. 1 and 2, a separator plate 49 extends horizontally between the turn arms 39, 40. The separator plate 49 has on its righthand end a support member **49*b* supported on the machine frame for back-and-forth movement and extends rearwardly between the lefthand ends of the Y-direction movable bases 31, 32, and also has on its distal end a rectangular enlarged portion 49*a* for separating the fabrics W1, W2 that are clamped by the holders 47, 48, respectively. An air cylinder 52 is coupled between the lefthand end of the first Y-direction movable base 31 and the front end of the support member 49*b*. When the piston rod of the air cylinder 52 is projected, the separator plate 49 is shifted to a retracted position indicated by the two-dot-and-dash lines in FIG. 1 for thereby allowing a presser 17 (described later) to press the fabrics W1, W2. When the piston rod of the air cylinder 52 is retracted, the separator plate 49 is shifted to an imaging position indicated by the solid lines in FIG. 1**.

Figure 16:
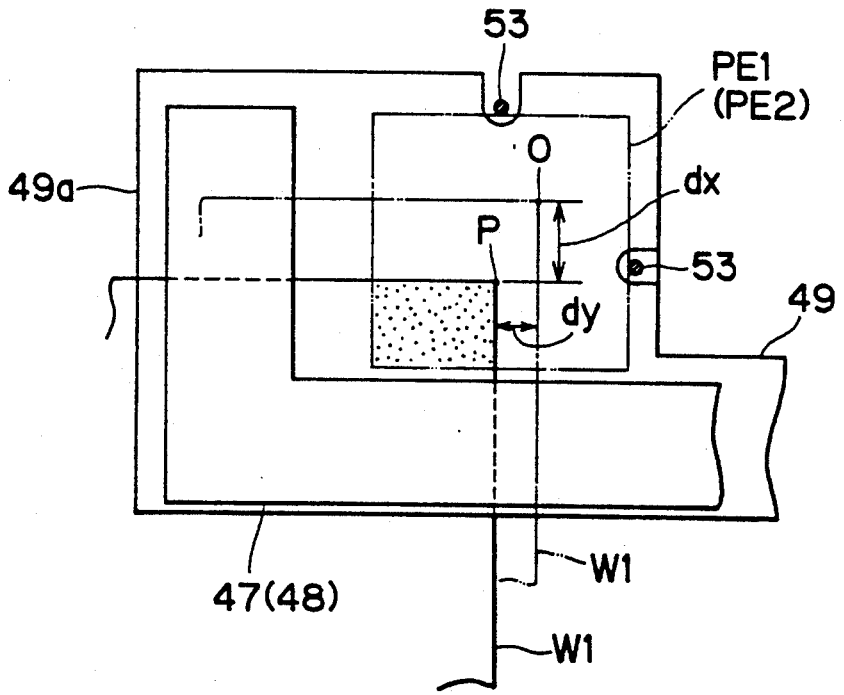
FIG. 16 is a fragmentary plan view showing imaging ranges.

A first two-dimensional image sensor 50 which comprises a CCD (charge-coupled device) with a color filter is disposed upwardly of the enlarged portion 49*a* for detecting a portion of the fabric W1 clamped by the first holder 47 through a color imaging process. The first two-dimensional image sensor 50 is supported by the first X-direction movable base 37. Similarly, a second two-dimensional image sensor 51 which is identical to the first image sensor 50 is disposed downwardly of the enlarged portion 49*a* for detecting a portion of the fabric W2 clamped by the second holder 48 through a color imaging process. The second two-dimensional image sensor 52 is supported by the second X-direction movable base 38. The first image sensor 50 images a portion or a predetermined range of the fabric W1 placed above the separator plate 49, and outputs a color image signal, and the second image sensor 51 images a portion or a predetermined range of the fabric W2 placed below the separator plate 49, and outputs a color image signal. The predetermined range, square in shape, in which the fabric W1 is imaged by the first image sensor 50, is regarded as a first imaging range PE1 over the separator plate 49, and the predetermined range, square in shape, in which the fabric W2 is imaged by the second image sensor 51, is regarded as a second imaging range PE2 over the separator plate 49, as shown in FIG. 16. These imaging ranges PE1, PE2 are of identical size, and identically positioned with respect to the separator plate 49. The imaging ranges PE1, PE2 have sides each extending parallel to the X or Y direction. When the holders 47, 48 are positioned with respect to the imaging ranges RE1, RE2 as shown in FIG. 16, the holders 47, 48 are in an imaging position.

As shown in FIGS. 1 and 2, a support table 54 for supporting the fabrics W1, W2 in the holders 47, 48 parallel to the separator plate 49 is disposed at the same level or height as the bed MB. The support table 54 has a righthand end portion with a recess defined therein which is long in the Y direction. A transparent glass plate 55 is fitted in the recess to allow the second image sensor 51 to image the fabric W2.

As shown in FIGS. 1 and 2, a presser feed mechanism 24 feeds the fabrics W1, W2 aligned on the support table 54 to a sewing position while pressing the fabrics W1, W2 on the support table 54, and also feeds the fabrics W1, W2 in synchronism with the feed to the sewing position while the fabrics W1, W2 are being sewn. The presser feed mechanism 24 includes a frame 14 directly above a position near the righthand end of the support table 54, the frame 14 being supported on the machine frame for movement in the Y direction. The frame 14 is of a rectangular shape as viewed in side elevation, the frame 14 being elongate in the Y direction, and is also of a closed cross-sectional shape. The frame 14 includes a lower beam 14*a* on which four presser solenoids 15*a*, 15*b*, 15*c*, 15*d* are mounted at suitable spaced intervals. Pressers 17 are fixed to the respective lower ends of rods 16 that are vertically actuatable by the respective presser solenoids 15*a*, 15*b*, 15*c*, 15*d*. The pressers 17 can be selectively moved by the corresponding presser solenoids 15*a* through 15*d* between a pressing position (see FIG. 2) in which the pressers 17 are actuated by the respective presser solenoids 15*a* through 15*d* to press the fabrics W1, W2 and an elevated position in which the pressers 17 are elevated in the vicinity of the beam 14*a*. The pressers 17 which are successively closer to the sewing machine SM are referred to as first, second, third, and fourth pressers 17, respectively.

A rack 56 is fixed to an upper surface of an upper beam 14*b* of the frame 14, the rack 56 extending the full length of the upper beam 14*b*. The rack 56 is held in mesh with a pinion 57 fixed to the drive shaft of a frame drive motor 58. When the frame drive motor 58 is energized, therefore, the frame 14 is driven to move in the Y direction through the meshing engagement of the rack 56 and the pinion 57.

Figure 3:
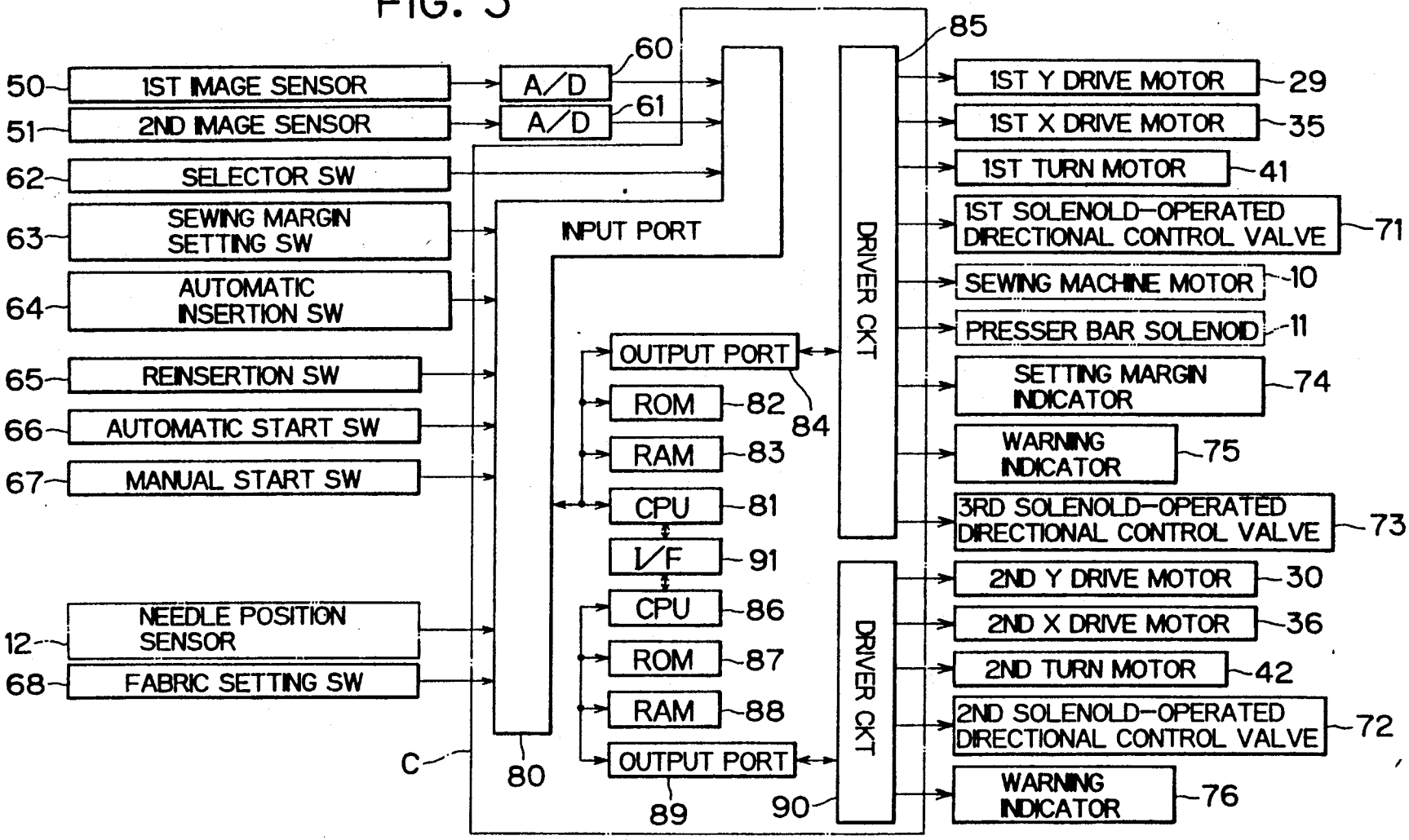
FIG. 3 is a block diagram of a control system of the fabric position correcting device.

The fabric position correcting device 20 has a control system housed in a control box CB. The control system is arranged as shown in FIGS. 3 and 4.

Figure 5:
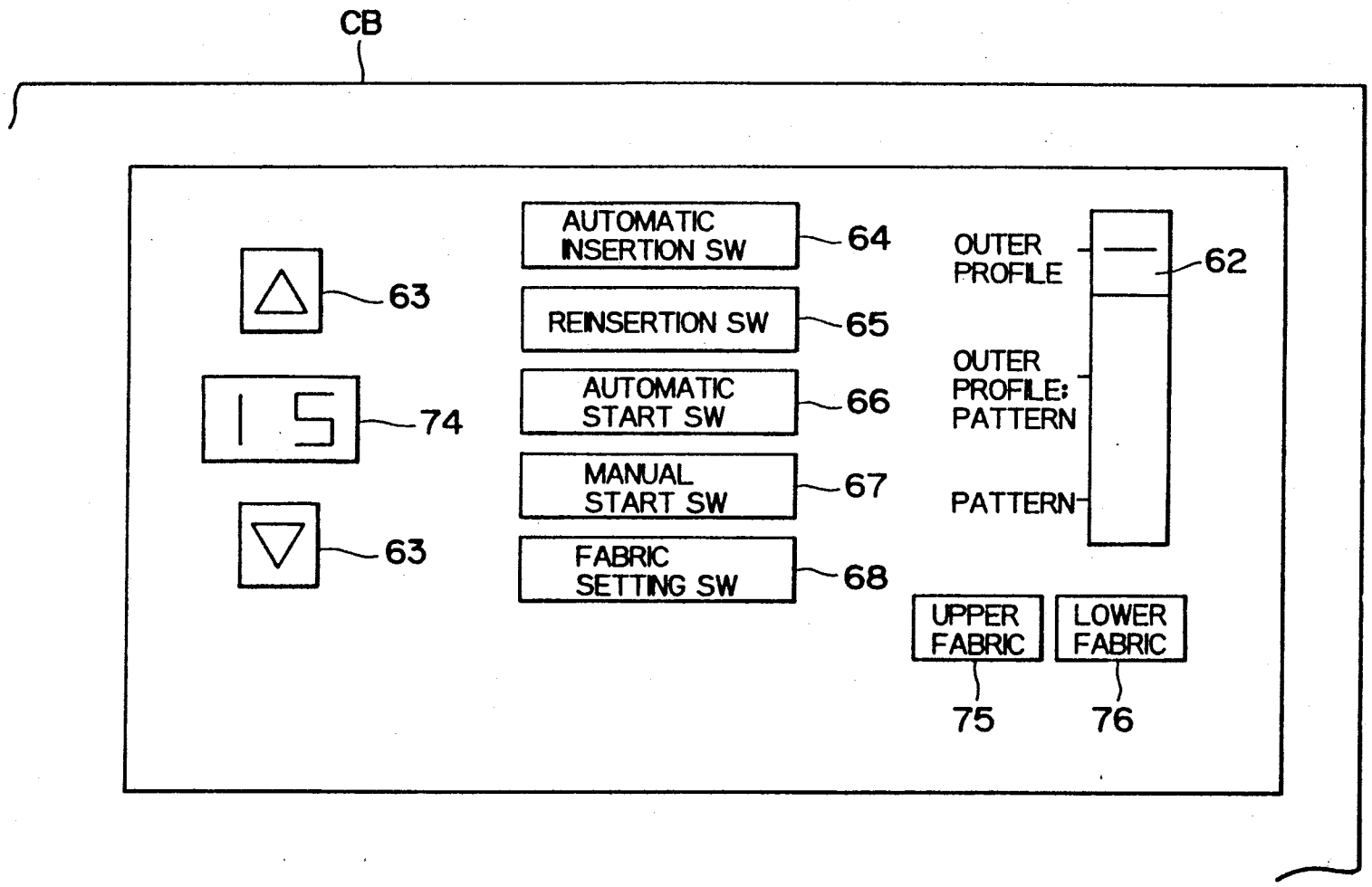
FIG. 5 is an enlarged fragmentary front elevational view of a control box.
Figure 6:
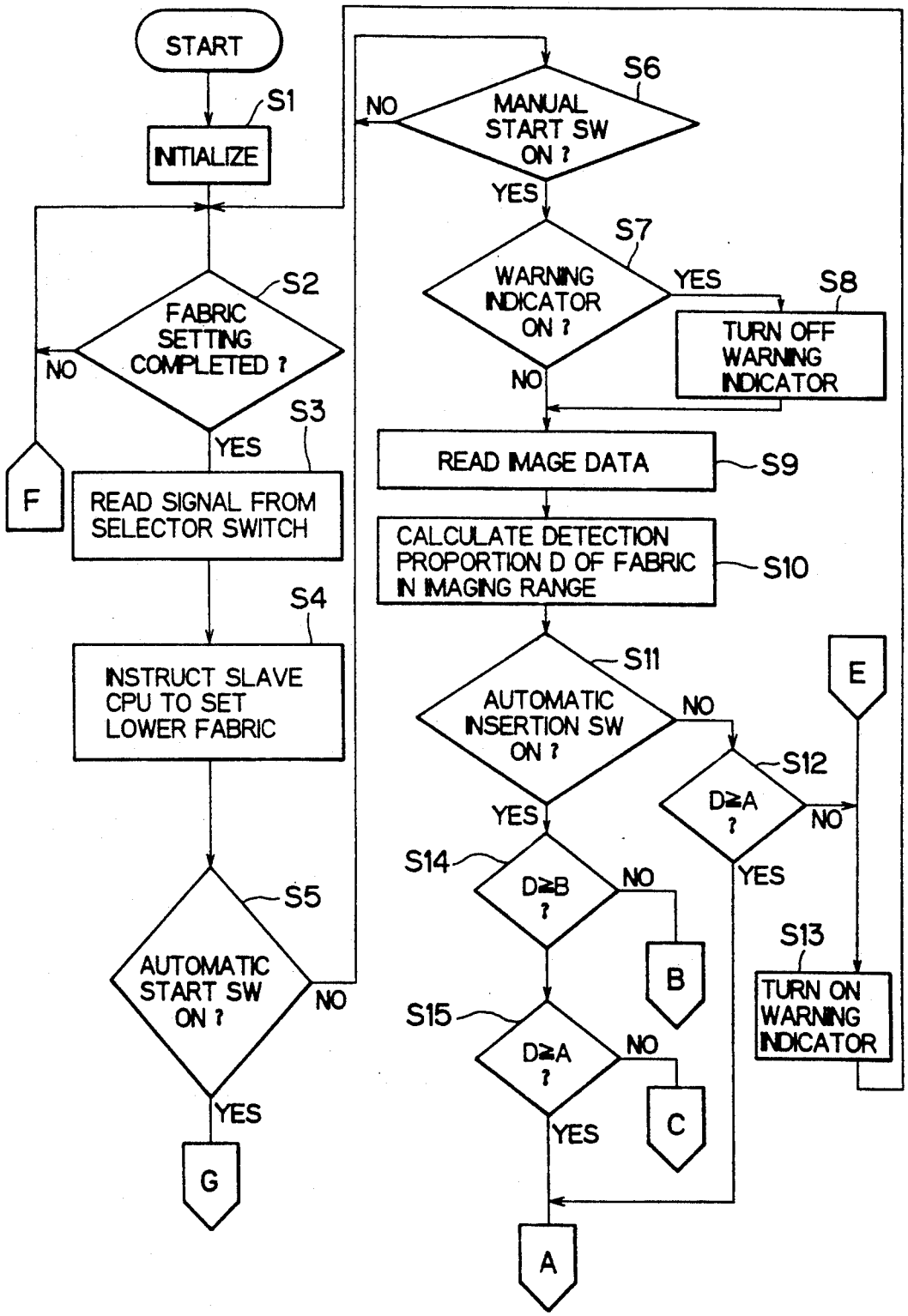
FIG. 6 is a flow chart of a routine for positional correction control.
Figure 7:
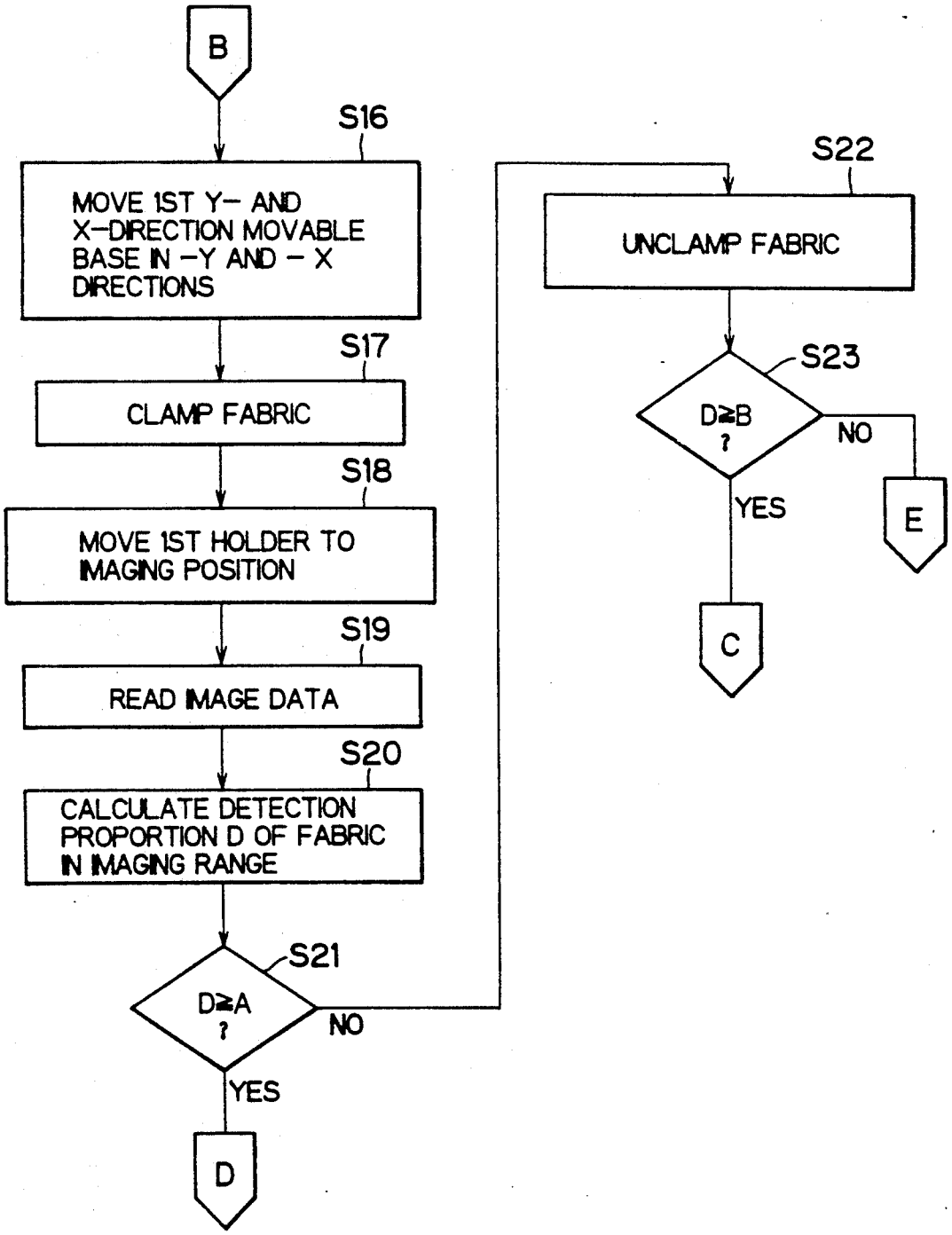
FIG. 7 is a flow chart of a portion of the routine for positional correction control.
Figure 8:
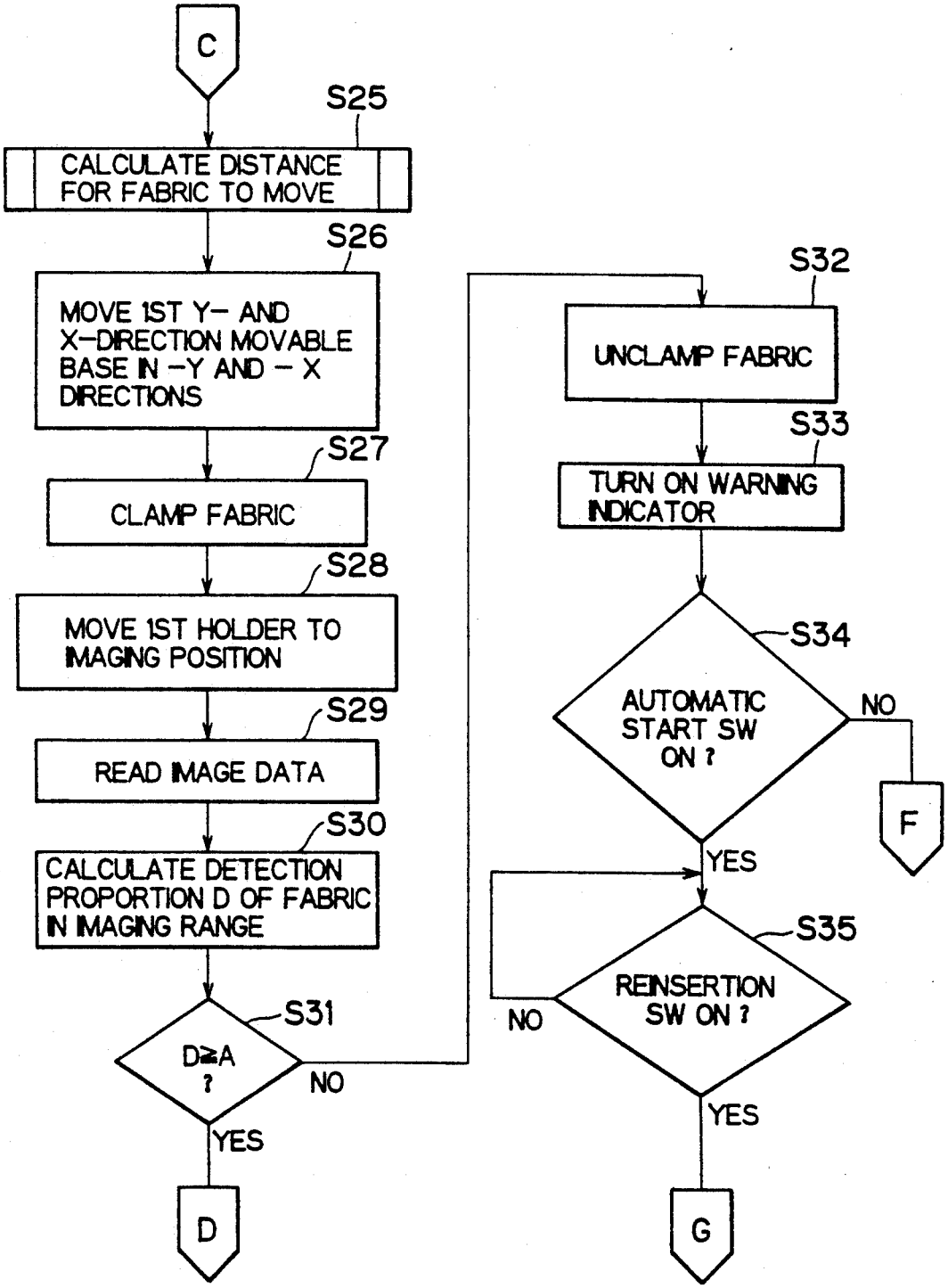
FIG. 8 is a flow chart of a portion of the routine for positional correction control.
Figure 9:
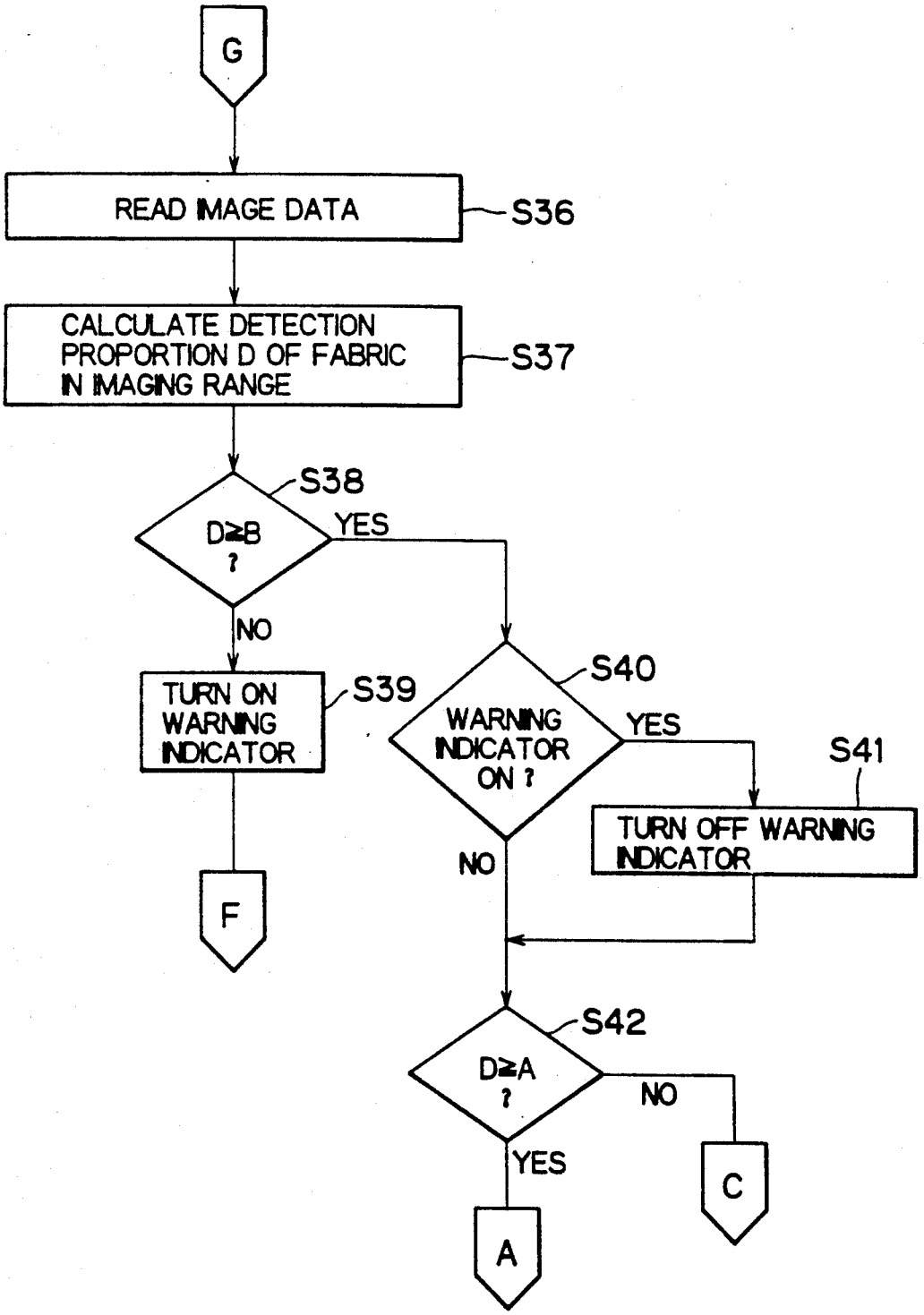
FIG. 9 is a flow chart of a portion of the routine for positional correction control.
Figure 10:
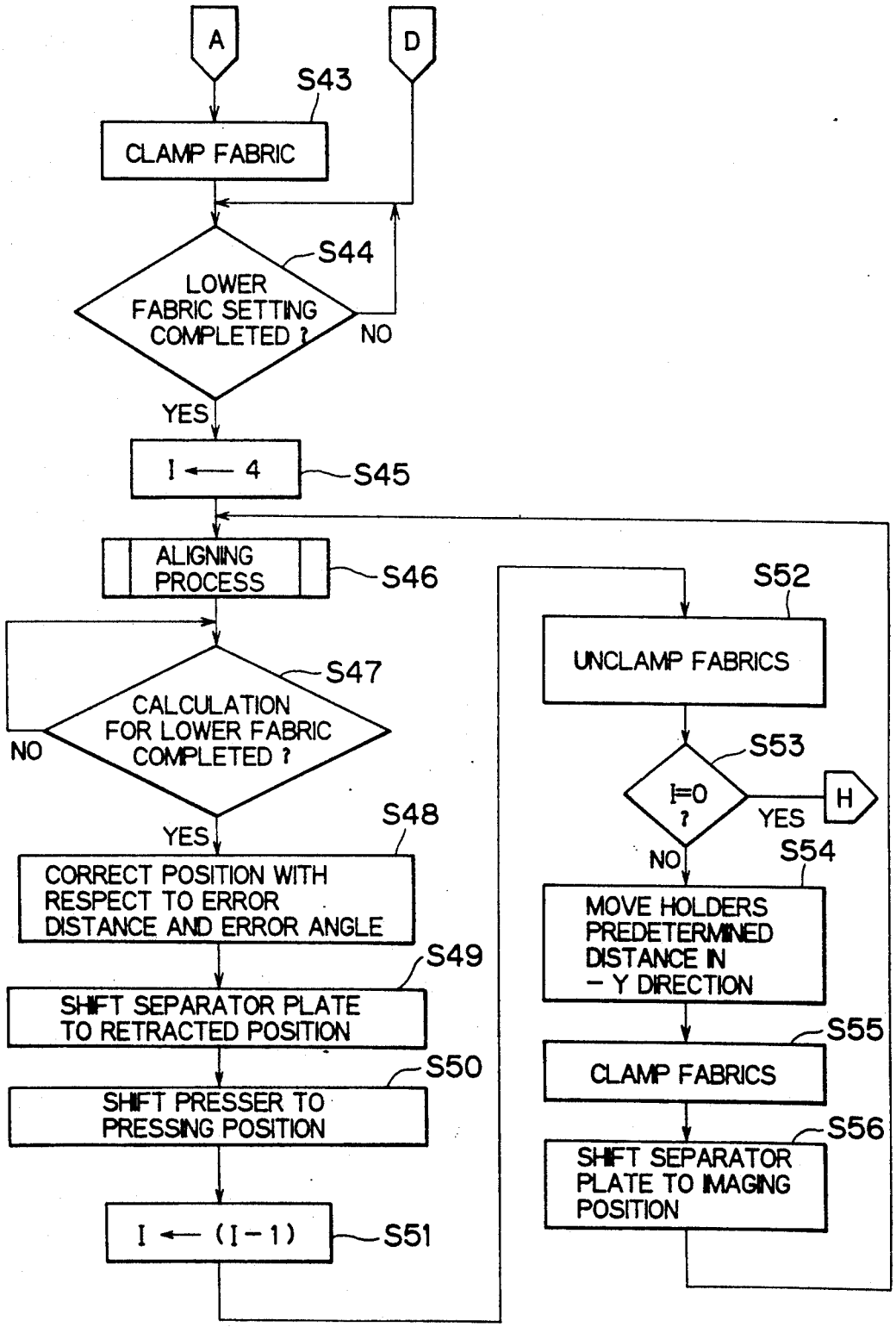
FIG. 10 is a flow chart of a portion of the routine for positional correction control.
Figure 11:
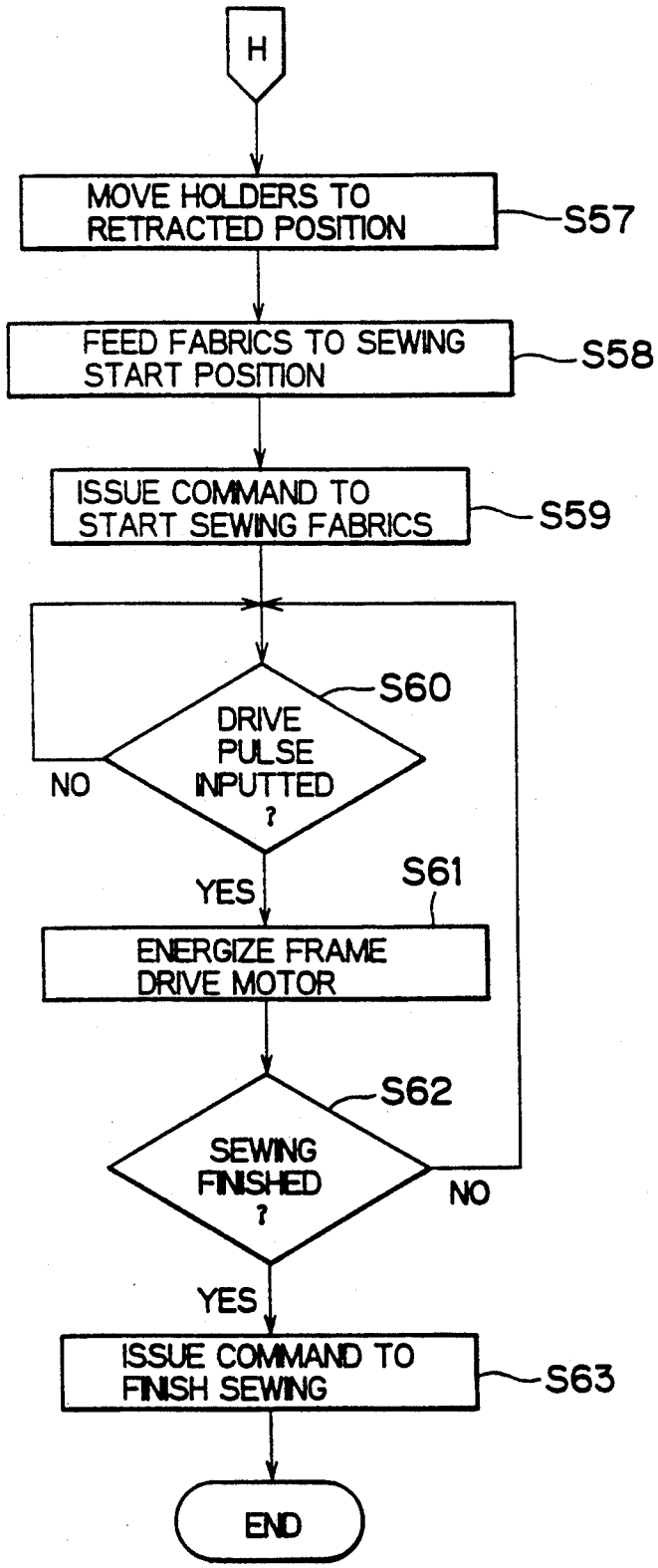
FIG. 11 is a flow chart of a portion of the routine for positional correction control.
Figure 12:
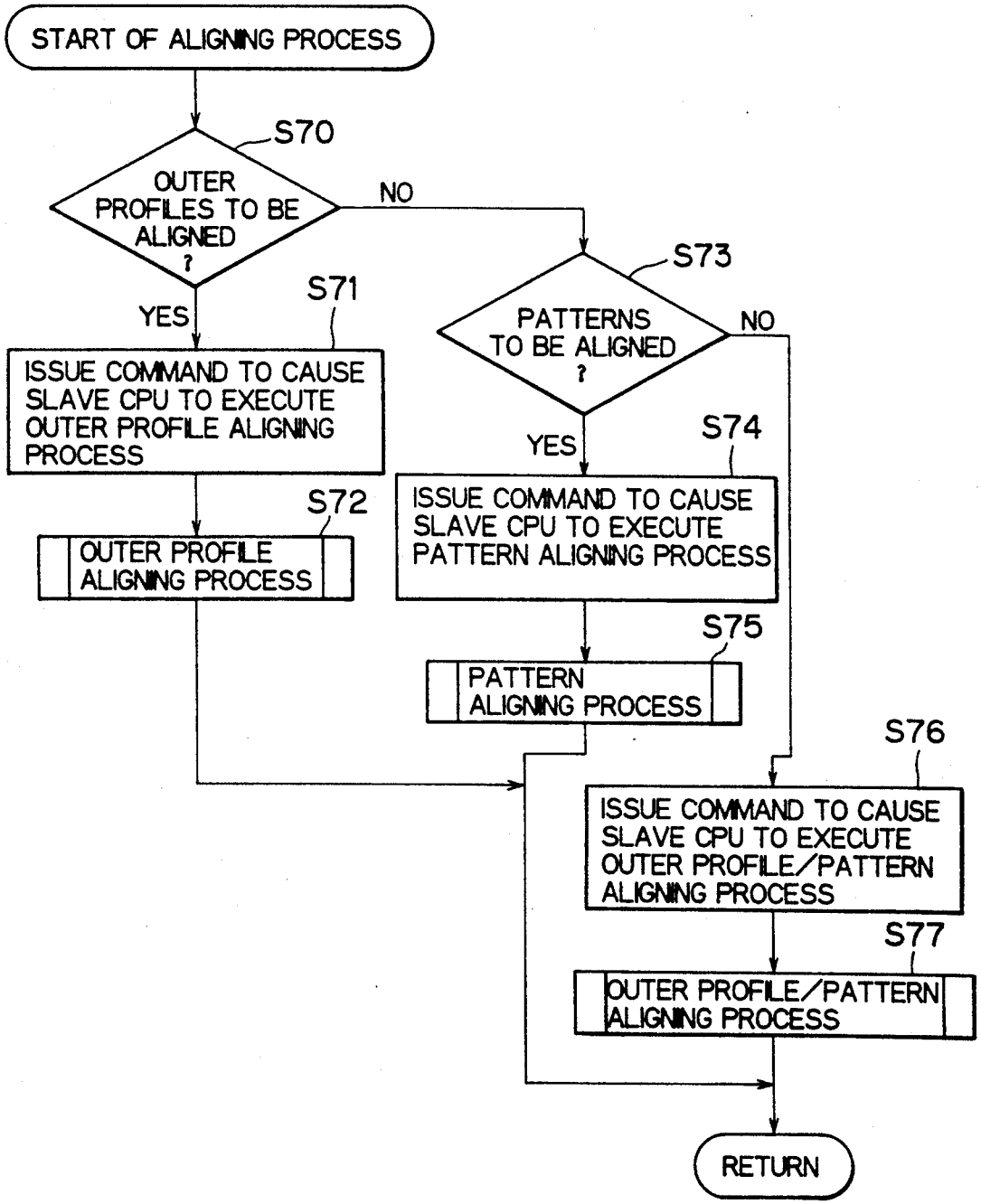
FIG. 12 is a flow chart of a portion of the routine for positional correction control.
Figure 13:
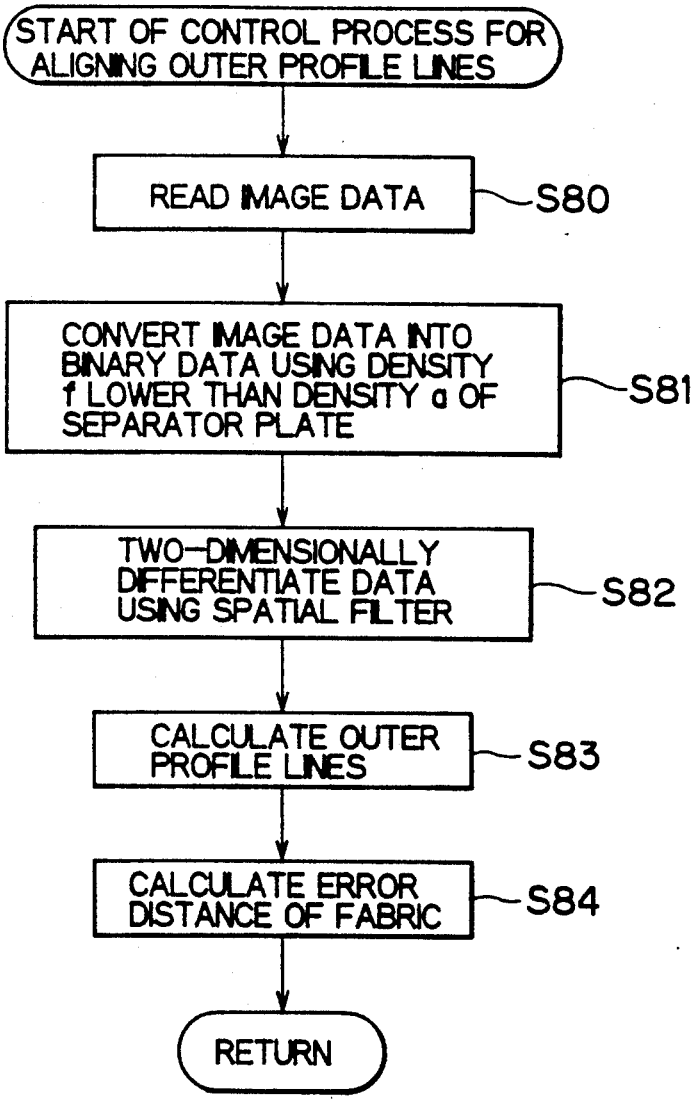
FIG. 13 is a flow chart of a portion of the routine for positional correction control.
Figure 14:
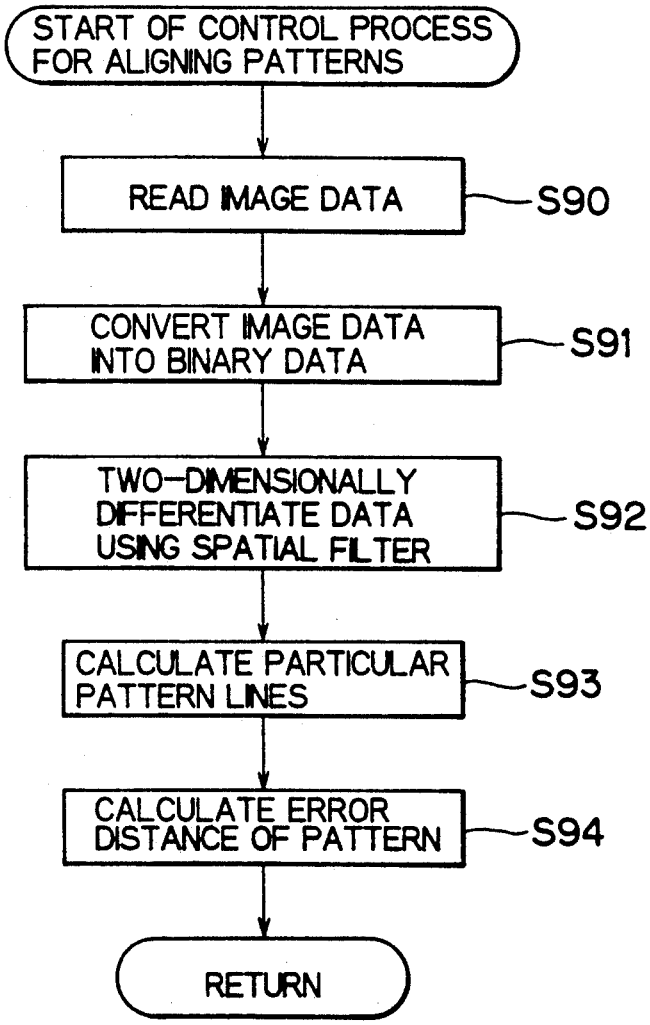
FIG. 14 is a flow chart of a portion of the routine for positional correction control.
Figure 15:
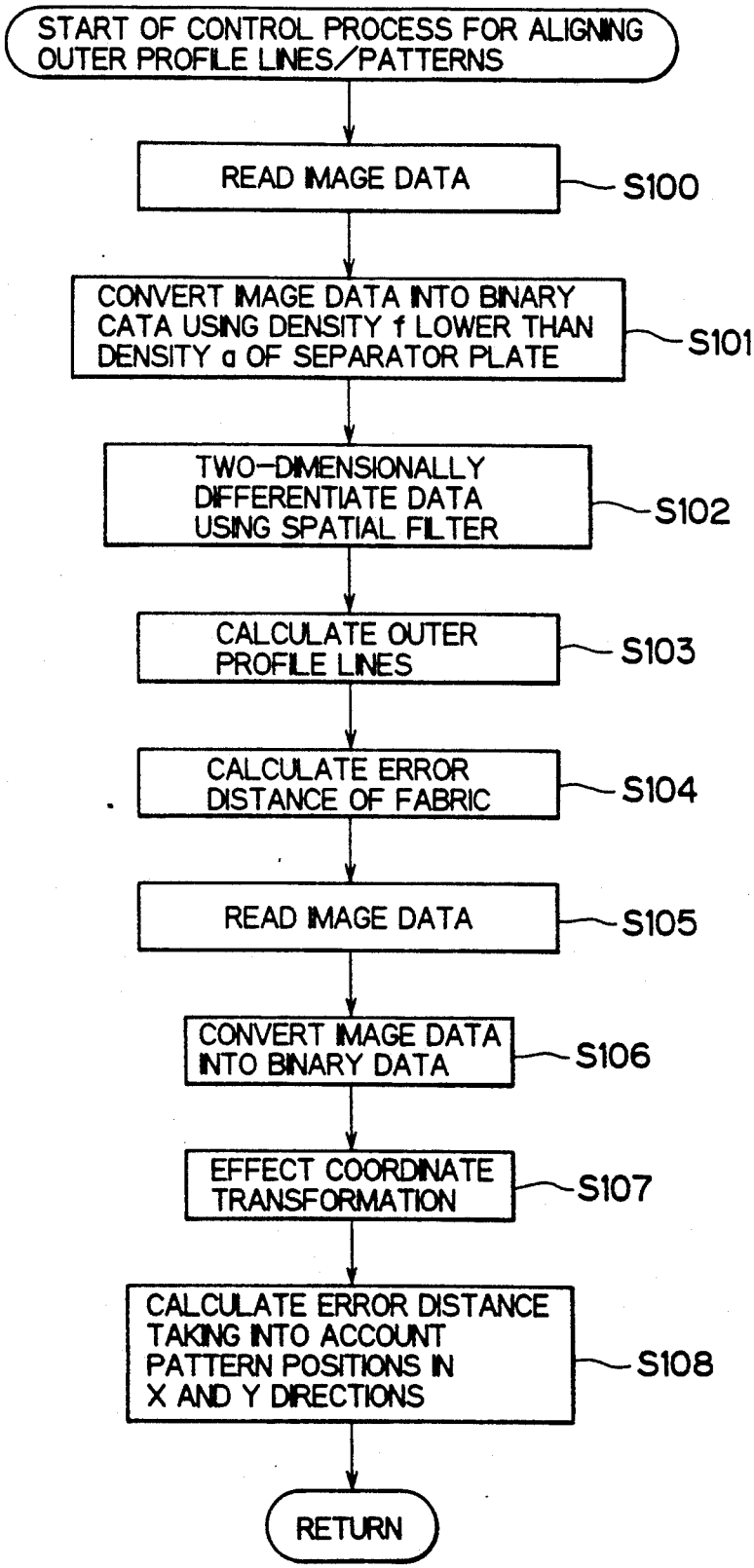
FIG. 15 is a flow chart of a portion of the routine for positional correction control.

The control system comprises a controller C having an input port 80 to which the first and second image sensors 50, 51 are connected through respective A/D converters 60, 61. To the input port 80, there are also connected a selector switch 62 for selecting a control process for aligning outer profile lines, a control process for aligning outer profiles/patterns, or a control process for aligning patterns, a sewing margin setting switch 63, an automatic insertion switch 64 for inserting the fabrics W1, W2 into the respective imaging ranges PE1, PE2, a reinsertion switch 65 to be operated on when the fabrics W1, W2 are reinserted, an automatic start switch 66 for automatically continuously controlling alignment of the fabrics W1, W2, a manual start switch 67 for manually continuously controlling alignment of the fabrics W1, W2, and a fabric setting switch 68 to be operated on when the manual setting of the fabrics W1, W2 is completed (see also FIG. 5). The needle position sensor 12 is also connected to the input port 80.

The controller C comprises a main CPU 81 for mainly controlling positional correction for the fabric W1, a ROM 82, a RAM 83, an output port 84, and a driver circuit 85. The input port 80, the ROM 82, the RAM 83, the output port 84, and the driver circuit 85 are connected to the main CPU 81 through a bus such as a data bus. The controller C also comprises a slave CPU 86 for controlling positional correction for the fabric W2, a ROM 87, a RAM 88, an output port 89, and a driver circuit 90. The ROM 87, the RAM 88, the output port 89, and the driver circuit 90 are connected to the CPU 86 through a bus. The CPU 81 and the CPU 86 are connected to each other through an interface 91. A first solenoid-operated directional control valve 71 actuates the first air cylinder 45 to project and retract its piston rod 45*a*. A second solenoid-operated directional control valve 72 actuates the second air cylinder 46 to project and retract its piston rod 46*a*. A third solenoid-operated directional control valve 73 actuates the air cylinder 52 to project and retract its piston rod which is connected to the support member 49*b*. A sewing margin indicator 74 indicates a sewing margin. Warning indicators 75, 76 serve to prompt the operator to set the fabrics W1, W2 again. The sewing machine motor 10, the solenoid 11, the first Y motor 29, the first X motor 35, the first turn motor 41, the first solenoid-operated directional control valve 71, the sewing margin indicator 74, the warning indicator 75, and the third solenoid-operated directional control valve 73 are connected to the driver circuit 85. The second Y motor 30, the second X motor 36, the second turn motor 42, the second solenoid-operated directional control valve 72, and the warning indicator 76 are connected to the driver circuit 90.

Figure 4:
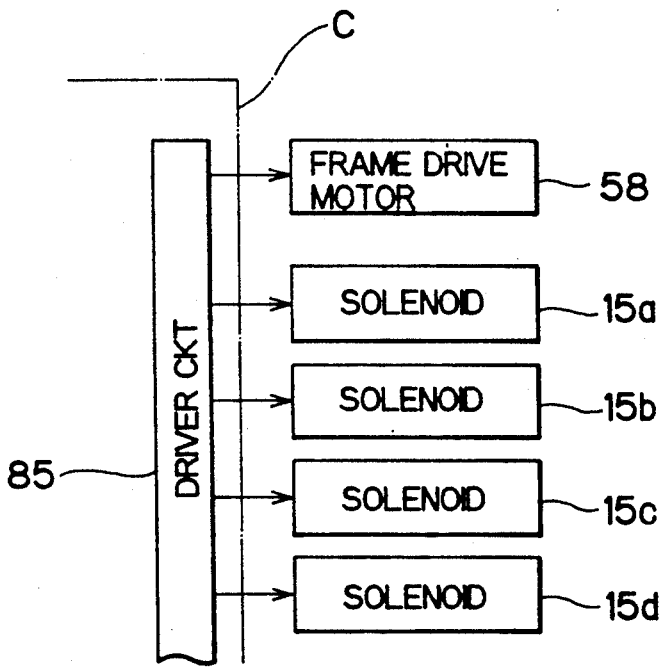
FIG. 4 is a block diagram of a portion of the control system of the fabric position correcting device.

As shown in FIG. 4, the frame drive motor 58 and the presser solenoids 15*a*, 15*b*, 15*c*, 15*d* are also connected to the driver circuit 85.

A routine or a control program for controlling the positional correction for the fabrics W1, W2, which is executed by the controller C of the fabric position correcting device 20, will be described below with reference to the flow charts of FIGS. 6 through 15. The control program is stored in the ROM 82. Denoted at Si (i=1, 2, 3,) in FIGS. 6 through 15 are steps of the routine.

When the power supply of the fabric position correcting device 20 is turned on, the control sequence is started. First, the various components of the fabric position correcting device 20 are initialized in a step S1. More specifically, in the step S1, the first and second Y motors 29, 30, the first and second X motors 35, 36, the first and second turn motors 41, 42 are energized to move the first and second holders 47, 48 into the imaging position shown in FIG. 16. The first and second solenoid-operated directional control valves 71, 72 are actuated to shift the first and second holding members 43, 44 into the angularly moved positions, respectively. The third solenoid-operated directional control valve 73 is actuated to move the separator plate 49 into the imaging position.

Fabrics W1, W2 are subsequently fed into a given position by a fabric loading device (not shown). In response to a loading completion signal from the fabric loading device or a loading completion signal from the fabric setting switch 68 that is operated on after the fabrics W1, W2 are manually set in position (step S2: Yes), a signal from the selector switch 62, indicative of the selected control process, is read in a step S3, and the main CPU 81 instructs the slave CPU 86 to set the fabric W2 in the second imaging range PE2 in a step S4. Then, the main CPU 81 executes a control process to set the fabric W1 in the first imaging range PE1 as follows: It is assumed that the automatic start switch 66 and the automatic insertion switch 64 are turned off. After it is determined that the automatic start switch 66 is turned off (step S5: No), if the manual start switch 67 is turned on (step S6: Yes) and the warning indicator 75 is turned on (step S7: Yes), then the warning indicator 75 is turned off in a step S8, and thereafter an image signal from the first image sensor 50, representing image data within the first imaging range PE1, is converted by the A/D converter 60 into a digital image signal which is stored in the RAM 83 as an image data memory in a step S9. The image data comprise a number of data corresponding to the pixels of the CCD of the first image sensor 50, and each representing the density of one of successive levels "0" to "255."

Figure 17:
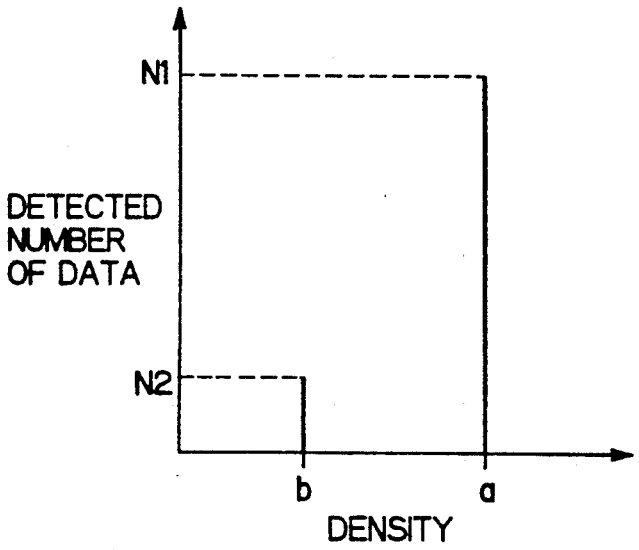
FIG. 17 is a diagram showing the relationship between densities and detected numbers of image data of a fabric detected in an imaging range.
Figure 18:
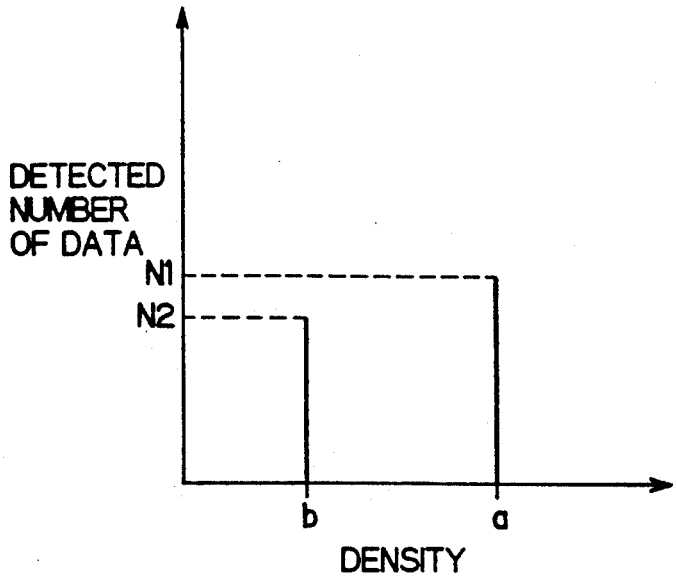
FIG. 18 is a diagram showing the relationship between densities and detected numbers of image data of a fabric detected in an imaging range.

Then, a step S10 calculates a proportion (detected proportion) D of the fabric W1 within the first imaging range PE1 based on the image data. For example, it is assumed that the corner of the fabric W1 is set in a position indicated by the solid line with respect to the first imaging range PE1, as shown in FIG. 16. As shown in FIG. 17, the detected number of image data for a density a corresponding to the separator plate 49 is N1, and the detected number of image data for a density b corresponding to the fabric W1 is N2. The sum of the number N1 and the number N2 is equal to a total number N of pixels of the CCD of the first image sensor 50. Therefore, the detected proportion D of the detected number N2 in the total number N of pixels can be determined. When the corner of the fabric W1 is set in a position indicated by the two-dot-and-dash line with respect to the first imaging range PE1, the detected number N1 is reduced and the detected number N2 is increased, as shown in FIG. 18, so that the detected proportion D of the fabric W1 is increased.

Since the automatic insertion switch 64 is turned off (step S11: No), control goes to a step S12 for determining whether or not the detected proportion D of the fabric W1 is equal to or greater than a predetermined value A (e.g., 45%). If the detected proportion D is equal to or greater than the predetermined value A (step 12: Yes), then control goes to a step S43. If the detected proportion D is smaller than the predetermined value A (step 12: No), then control goes to a step S13 in which the warning indicator 75 is turned on, and control returns to the step S2.

Now, it is assumed that the automatic start switch 66 is turned off and the automatic insertion switch 64 is turned on. After it is determined that the automatic start switch 66 is turned off (step S5: No), the steps S6 through S10 are executed, as described above, and then it is determined that the automatic insertion switch 64 is turned on (step S11: Yes). Thereafter, if the detected proportion D of the fabric W1 is equal to or greater than a predetermined value B (e.g., 10%) and also equal to or greater than the predetermined value A (steps S14, S15: Yes), then control goes to the step S43. If the detected proportion D is smaller than the predetermined value B (step S14: No), the fabric W1 is automatically inserted into the first imaging range PE1 in steps S16 through S18. More specifically, in order to make the detected proportion D equal to or greater than the predetermined value A, the first Y motor 29 and the first X motor 35 are energized to move the first holder 47 from the present imaging position certain distances in −Y and −X directions based on a predetermined distance that substantially corresponds to the length (about 10 cm) of one side of the first imaging range PE1, in a step S16. The fabric W1 is clamped by the first holder 47 in a step S17. Thereafter, the first holder 47 is returned to the original imaging position based on the above predetermined distance, thereby automatically inserting the fabric W1 into the first imaging range PE1 in a step S18.

Then, the image data of the fabric W1 that has been automatically inserted is read in a step S19, and the detected proportion D of the fabric W in the imaging range is calculated in a step S20. If the detected proportion D is equal to or greater than the predetermined value A (step S21: Yes), then control goes to a step S44. If the detected proportion D is smaller than the predetermined value A (step S21: No), then the fabric W1 is unclamped from the first holder 47 in a step S22. If, thereafter, the detected proportion D is equal to or greater than the predetermined value B (step S23: Yes), then the fabric W1 is automatically inserted again in steps S25 through S28. If the detected proportion D is smaller than the predetermined value B (step S23: No), then the warning indicator 75 is turned on in the step S13, and control goes back to the step S2.

If the detected proportion D is smaller than the predetermined value A (step S15: No) and also equal to or greater than the predetermined value B (step S23: Yes), i.e., if the fabric W1 is set in the position indicated by the solid line in FIG. 17, then a point P of intersection (corner) of two outer profile line lines of the fabric W1, which are represented by large changes in the densities corresponding to pixels, are determined based on the image data, and distances dx, dy from the point P of intersection to a point O where the detected proportion D is greater than the predetermined value A are determined in a step S25. Then, the first Y motor 29 and the first X motor 35 are energized to move the first holder 47 the distance dy in the −Y direction and the distance dx in the −X direction in a step S26. Based on the distances dx, dy, the first holder 47 is returned to the original imaging position in a step S28.

The image data of the fabric W1 after having been moved is read again in a step S29, and then the detected proportion D of the fabric W1 with respect to the first imaging range PE1 is calculated in a step S30. If the detected proportion D is equal to or greater than the predetermined value A (step S31: Yes), then control proceeds to the step S44. If the detected proportion D is smaller than the predetermined value A (step S31: No), then the fabric W1 is unclamped in a step S32, and the warning indicator 75 is turned on in a step S33. Since the automatic start switch 66 is turned off (step S34: No), control goes back to the step S2.

It is assumed that the automatic start switch 66 is turned on and the automatic insertion switch 64 is turned on. After it is determined that the automatic start switch 66 is turned on (step S5: Yes), the image data of the fabric W1 is read in a step S36, and the detected proportion D of the fabric W1 with respect to the first imaging range PE1 is calculated in a step S37. If the detected proportion D is smaller than the predetermined value B (step S38: No), then control goes to a step S39 in which the warning indicator 75 is turned on, and then control goes back to the step S2. If the detected proportion D is equal to or greater than the predetermined value B (step S38: Yes), then control goes to a step S40. Since the warning indicator 75 is turned on (step S40: Yes), it is turned off in a step S41. If the detected proportion D is equal to or greater than the predetermined value A (step S42: Yes), then the control goes to the step S43. If the detected proportion D is smaller than the predetermined value A (step S42: No), then the steps S25 through S30 described above are executed. After the steps S25 through S30, if the detected proportion D is equal to or greater than the predetermined value A (step S31: Yes), then control goes to the step S44. If the detected proportion D is smaller than the predetermined value A, then the steps S32 through S34 are executed, prompting the operator to insert the fabric W1 again.

If the answers to the decision steps S12, S15, S42 are Yes, then the fabric W1 is clamped by the first holder 47 in the step S43. If the answers to the decision steps S21, S31 are Yes, then after the setting of the fabric W1 is completed, the step S44 is repeated until a setting completion signal indicating the completion of setting of the fabric W1 is inputted from the CPU 86.

Based on the control program stored in the ROM 87 for setting fabrics, the CPU 86 executes the same routine as the steps S5 through S43 with respect to the fabric W2. When the detected proportion D of the fabric W2 with respect to the second imaging range PE2 is equal to or greater than the predetermined value A, the CPU 86 outputs a setting completion signal indicating the completion of setting of the fabric W2 to the main CPU 81.

The value "4" corresponding to the number of pressers 17 is stored as a count I of a counter in the RAM 83 in a step S45. Then, an aligning process (see FIG. 12) is executed in a step S46.

After the aligning process has been started, if outer profile lines are to be aligned based on the signal from the selector switch 62 (S70: Yes), then the CPU 86 is instructed to effect the control process for aligning outer profile lines with respect to the fabric W2 in a step 71, and the control process for aligning outer profile lines with respect to the fabric W1 (See FIG. 13) is executed in a step S72. If patterns are to be aligned (S70: No, S73: Yes), then the CPU 86 is instructed to effect the control process for aligning patterns with respect to the fabric W2 in a step 74, and the control process for aligning patterns with respect to the fabric W1 (See FIG. 14) is executed in a step S75. If outer profile and patterns are to be aligned (S70: No, S73: No), then the CPU 86 is instructed to effect the control process for aligning outer profiles/patterns with respect to the fabric W2 in a step 76, and the control process for aligning outer profiles/patterns with respect to the fabric W1 (See FIG. 15) is executed in a step S77.

Figure 19:
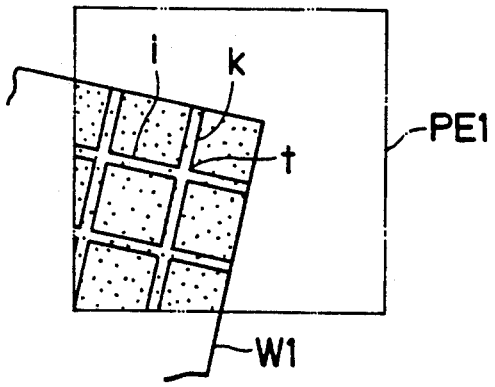
FIG. 19 is a diagram showing the relationship between the positions of an imaging range and a fabric set in place.
Figure 20:
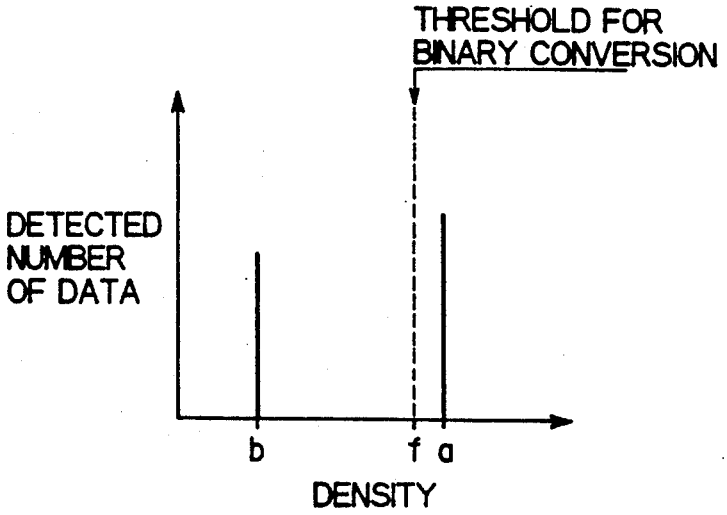
FIG. 20 is a diagram showing the relationship between densities and detected number of image data of a detected separator plate, a fabric, and a pattern.

The control process for aligning outer profile lines of the fabric W1 will be described below with reference to FIGS. 19 through 24. The control process for aligning outer profile lines of the fabric W2 is the same as the control process for aligning outer profile lines of the fabric W1, and will not be described below. The image data of the fabric W1 set as shown in FIG. 19, within the first imaging range PE1, is read and stored in the image data memory or the RAM 83 in a step S80. The image data is then converted into binary data, using as a threshold value a density f that is slightly lower than the highest density a corresponding to the separator plate 49, as shown in FIG. 20, thus determining a detected region of the fabric W1 which is shown hatched in FIG. 21, in a step S81. The density of the fabric W1 is indicated by b, and the density of the pattern (striped pattern) is indicated by c in FIG. 20. Then, each item of the density data stored in the image data memory is two-dimensionally differentiated using a spatial filter (e.g., a Laplacian filter shown in FIG. 22) composed of a plurality of coefficients, thereby determining image data representative of an outer profile of the fabric W1 as shown in FIG. 23 in a step S82.

Then, a step 83 calculates two outer profile lines $y=a_1x+b_1$, $y=a_2x+b_2$ corresponding to the determined outer profile of the image data in an xy coordinate system in the XY plane. More specifically, the equation $y=a_1x+b_1$ is converted into an equation $b_1=-a_1x+y$ according to the Hough transform, and an ab plane is assumed with $a_1$, $b_1$ regarded as variables. In the ab plane, points $(x_1, y_1)$, $(x_2, y_2)$, corresponding to a profile line contained in the xy plane shown in FIG. 23 correspond respectively to a "slope" and an "intercept," and hence there is a straight line existing for each of the points. Based on a point (a, b) where the straight lines intersect, the slope a and the intercept b can be determined in the xy plane.

Likewise, if there are two straight lines in the xy plane, there are two points of intersection of straight lines in the ab plane. Two outer profile lines in the xy plane can be determined from these two points of intersection.

Figure 24:
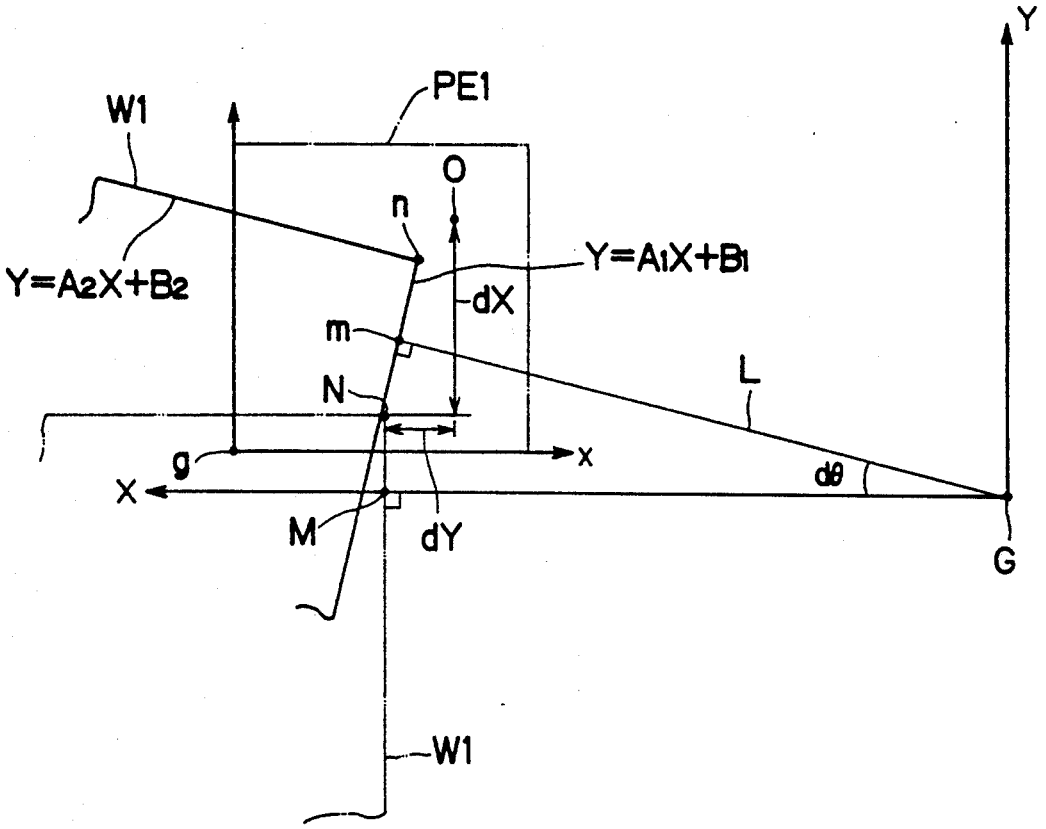
FIG. 24 is a diagram showing the manner in which two outer profile lines at a corner of a fabric are determined.
Figure 25:
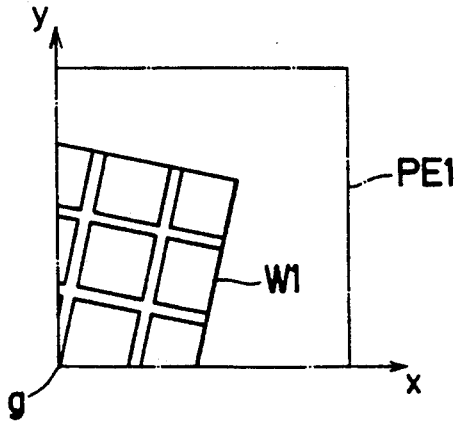
FIG. 25 is a diagram similar to FIG. 19, illustrating a pattern alignment.

Then, an error distance and an error angle are calculated in a step S84 to correct the position of the fabric W1 into a preset position in which the corner of the fabric W1 agrees with a reference position 0 (X0, Y0) in an XY plane (described later on) taking a sewing margin into account and also in which the outer profile line $y=a_1x+b_1$ extends parallel to the Y direction. Specifically, as shown in FIG. 24, the two profile lines $y=a_1x+b_1$, $y=a_2x+b_2$ are transformed from the xy coordinate system which has an origin g in the first imaging range PE1 into an XY coordinate system which an origin G about which the first holder 47 is rotatable, thus determining transformed profile lines $Y=A_1X+B_1$, $Y=A_2X+B_2$. The error angle $d\theta$ and the error distance dXdY which are necessary for positional correction are determined as follows: As shown in FIG. 24, a point m on the profile line $Y=A_1X+B_1$ is a point of intersection between the profile line $Y=A_1X+B_1$ and a line L perpendicular thereto, and a point n is a point of intersection between the profile lines $Y=A_1X+B_1$, $Y=A_2X+B_2$. A position in which the fabric W1 is first set is indicated by the solid line, and an imaginary position which is achieved by the fabric W1 after having been angularly moved counterclockwise from the solid-line position by an error angle $d\theta$ is indicated by the two-dot-and-dash line. Therefore, the coordinates (Xn, Yn) of the point n are determined from the two profile lines $Y=A_1X+B_1$, $Y=A_2X+B_2$. Since the line L extends perpendicularly to the profile line $Y=A_1X+B_1$ and passes through an origin G, the line L is expressed by $Y=-X/A_1$, allowing the coordinates (Xm, Ym) of the point m to be determined. The error angle $d\theta$ can be determined from the slope $A_1$ of the line L. The coordinates $((Xm_2+Ym_2)^{\frac{1}{2}}, 0)$ of a point M are determined using the coordinates (Xm, Ym) of the point m. The coordinates (XN, XY) of a point N are indicated by $XN= Xn \cos(d\theta)-Yn \sin(d\theta)$, $YN=Xn \sin(d\theta)+Yn \cos(d\theta)$ using the coordinates (Xn, Yn) of the point n, and hence $dX=Xo-XN$, $dY=Yo-YN$.

The control process for aligning patterns of the fabric W1 will be described below. The control for aligning patterns of the fabric W2 is the same as the control process for aligning patterns of the fabric W1, and will not be described below. The control process for aligning patterns of the fabric W1 is substantially the same as the control process for aligning outer profiles. The image data of the fabric W1 set as shown in FIG. 19, within the first imaging range PE1, is read in a step S90. The image data is then converted into binary data, using as a threshold value a density f that is slightly lower than the highest density a corresponding to the separator plate 49, and also converted into binary data, using as a threshold value a density that is slightly lower than the density c corresponding to the striped pattern. Based on these binary data, image data representative of the extracted striped pattern only is determined in a step S91. Then, the image data is two-dimensionally differentiated using a spatial filter, thereby determining image data representative of an outer profile of the striped pattern in a step S92.

Thereafter, the equations of the particular two striped pattern lines j, k as shown in FIG. 19 are determined in the same manner as with the aforesaid control process of aligning outer profiles in a step S93. Then, in a step S94, an error distance (dXdY) and an error angle $d\theta 2$ pf the striped pattern are calculated with respect to a preset position in which the point of intersection of these two striped pattern lines j, k agrees with a reference position 0 (X0, Y0) taking a sewing margin into account and also in which the striped pattern line k extends parallel to the Y direction.

The control process for aligning outer profiles/patterns of the fabric W1 will be described below. The control for aligning outer profiles/patterns of the fabric W2 is the same as the control process for aligning outer profiles/patterns of the fabric W1, and will not be described below. The control process for aligning outer profiles/patterns of the fabric W1 includes steps S100 through S104 (FIG. 15) which are the same as the steps S80 through S84 shown in FIG. 13. Other steps S105 through S108 of the control process will be described below with reference to FIGS. 25 through 28.

Figure 26:
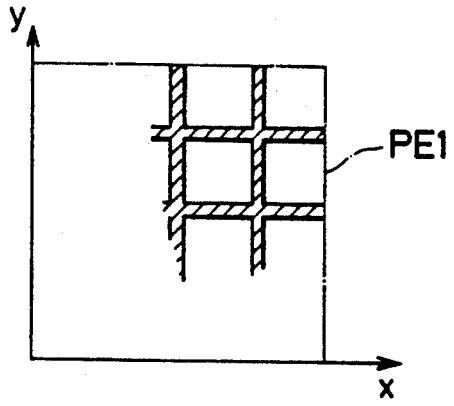
FIG. 26 is a diagram showing a coordinate transformation of striped pattern lines in an xy plane.
Figure 27:
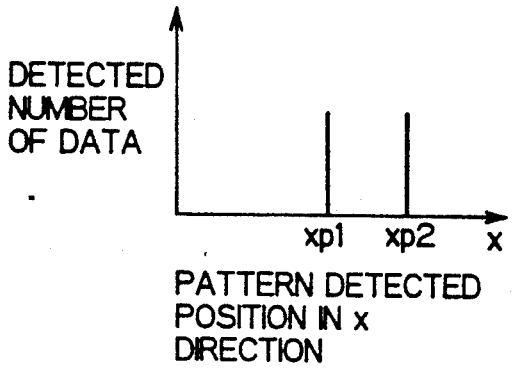
FIG. 27 is a diagram showing detected positions of a striped pattern on an x-axis.
Figure 28:
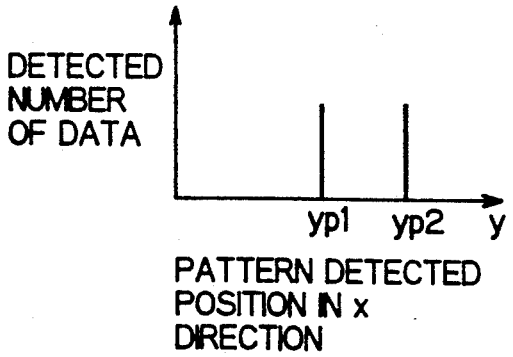
FIG. 28 is a diagram showing detected positions of a striped pattern on a y-axis.

The image data of the fabric W1 set as shown in FIG. 25 is read again in a step S105. The image data is then converted into binary data, using as a threshold value a density f that is slightly lower than the highest density a corresponding to the separator plate 49, and also converted into binary data, using as a threshold value a density that is slightly lower than the density c corresponding to the striped pattern, as described with reference to FIG. 20. Based on these binary data, image data representative of the extracted striped pattern only is determined in a step S106. Then, as shown in FIG. 26, the image data is turned in the same direction through the error angle $d\theta$ that has been determined in the step S104, and is subjected to a coordinate transformation so that the corner agrees with the corner of the imaging range PE1 in a step S107. Pattern positions (xp1, xp2) in the X direction are determined as shown in FIG. 27, and pattern positions (yp1, yp2) in the Y direction are determined as shown in FIG. 28 in a step S108, whereupon the control process is completed.

If a signal indicative of the completion of the calculation of an error distance with respect to the fabric W2 is outputted from the CPU 86 in a step S47 (S47: Yes), then the motors 29, 30, 35, 36, 41, 42 are energized based on the X-direction error distance dX, the Y-direction error distance dY, and the error angle $d\theta$ with respect to the fabrics W1, W2 for thereby correcting the positions of the fabrics W1, W2 to eliminate positional errors relative to shapes or patterns based on the selected control process in a step S48. It is assumed that the control process for aligning outer profiles/patterns is executed. If the pattern position of the fabric W2 is to be aligned with reference to the pattern position of the fabric W1, then the error distance (dXdY) and the error angle $d\theta$ which have been determined in the step S104 are applied to the fabric W1, and a final error distance (dXdY) and error angle $d\theta$ based on the error distance and error angle which have been determined in the step S104 and the pattern error distance are calculated with respect to the fabric W2. The positional correction is then effected based on these error distances.

Figure 29:
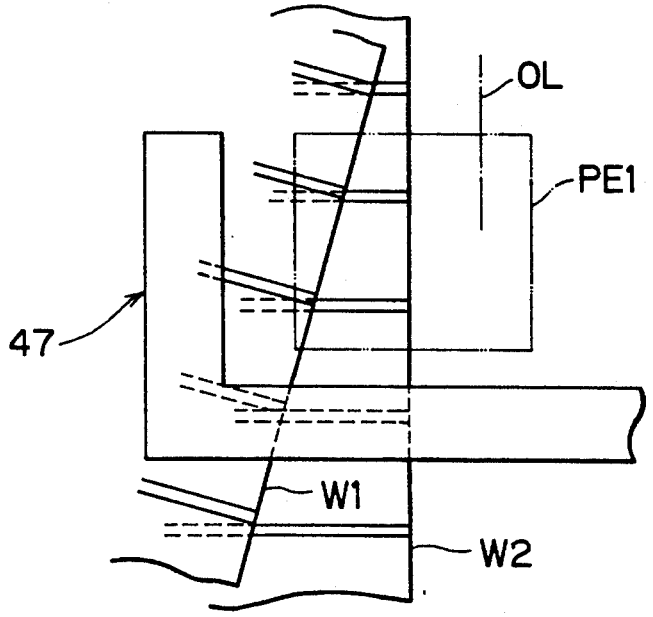
FIG. 29 is a diagram illustrative of the correction of a positional shift of an intermediate portion of a fabric.
Figure 30:
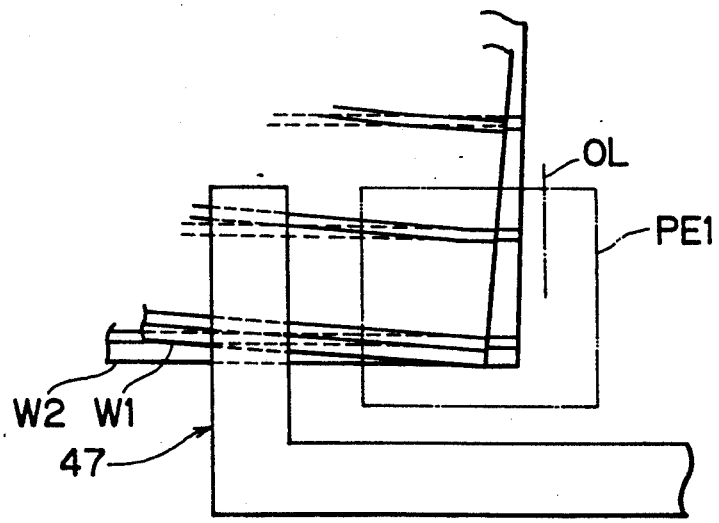
FIG. 30 is a diagram illustrative of the correction of a positional shift of a trailing end portion of a fabric.

Then, the third solenoid-operated directional control valve 73 is actuated to shift the separator plate 49 to the retracted position in a step S49. The presser solenoid 15*a* is energized to shift the first presser 17 to the pressing position for pressing and holding the fabrics W1, W2 with their distal ends aligned with each other in a step S50. Thereafter, the count I of counter is decremented by 1 in a step S51, and the fabrics W1, W2 are unclamped in a step S52. If the count I is not "0" in a step S53 (S53: No), then the holders 47, 48 are moved a predetermined distance in the-Y direction so that they correspond to the second presser 17 in a step S54. In this position, the fabrics W1, W2 are clamped in a step S55, and the separator plate 49 is shifted again to the imaging position in a step S56. Thereafter, the steps S46 through S56 are repeated. If the aligned position is at a portion of the fabrics W1, W2 which corresponds to the second or third presser 17, then an error distance and an error angle of the fabric portion with respect to a reference line OL containing a reference point O and parallel to a Y-axis are calculated whichever control process is selected, as shown in FIG. 29. If the aligned position is at a trailing end portion of the fabrics W1, W2 which corresponds to the fourth presser 17, then an error distance and an error angle of the fabric portion with respect to a reference line OL containing a reference point O and parallel to a Y-axis are calculated whichever control process is selected, as shown in FIG. 30.

If four portions of the fabrics W1, W2 corresponding to the respective pressers 17 are pressed by these pressers 17 and the count I becomes "0" in the step S53 (S53: Yes), then the holders 47, 48 are moved to a retracted position where they will not obstruct movement of the frame 14 in a step S57. The frame drive motor 58 is energized to feed the aligned fabrics W1, W2 to the sewing start position in a step S58. Then, in response to a command to start a sewing operation, the solenoid 11 is energized to shift the presser bar to the pressing position, and the sewing machine motor 10 is energized in a step S59. In the sewing operation, if drive pulses supplied to the motor of the sewing machine SM for moving the feed dog back and forth are inputted in a step S60 (S60: Yes), the frame drive motor 58 is energized by one pulse in a step S61. Unless a sewing stop switch for stopping the sewing operation is operated on in a step S62 (S62: No), the steps S60 through S62 are repeated. If the sewing operation is brought to an end (S62: Yes), then a command to finish the sewing operation is issued to de-energize the sewing machine motor 10 when the needle bar reaches an uppermost position, and the presser foot is shifted to the elevated position in a step S63. Then, the control program for controlling the positional correction comes to an end.

As described above, the method according to the present invention effects, using the fabric position correcting device 20, the step (S52 to S56, S46 to S47) of detecting the position of at least one of an outer profile line and a pattern of a fabric portion corresponding to one of the pressers 17, the step (S48) of correcting the position of the fabric portion while holding the same whose position has been detected, and the step (S49 to S50) of pressing the fabric portion with the presser 17 after the position thereof has been corrected. The aligning process composed of the above three steps is carried out four times successively with respect to fabric portions corresponding to the respective pressers 17 from the leading end of the fabric in the direction in which it is fed. Then, the positionally corrected fabrics W1, W2 are fed to the sewing start position. Therefore, the positional correction of the fabrics W1, W2 relative to at least one of the outer profile line and the pattern thereof can be accurately, reliably, and automatically carried out from the leading end to trailing end of the fabrics W1, W2.

In addition, after the fabrics W1, W2 have been sewn by the lock-stitch sewing machine SM, the fabrics W1, W2 are fed by the presser feed mechanism 24 in synchronism with the fabric feeding by the sewing machine SM. Consequently, the positional correction and the sewing operation of the fabrics W1, W2 can be carried out in an automatized successive process.

Since the fabric position correcting device 20 has a pair of position correcting mechanisms for positionally correcting the two fabrics W1, W2, respectively, the positional correction and the sewing operation of at least one of the outer profile and the pattern of the fabrics W1, W2 can greatly be simplified.

Figure 31:
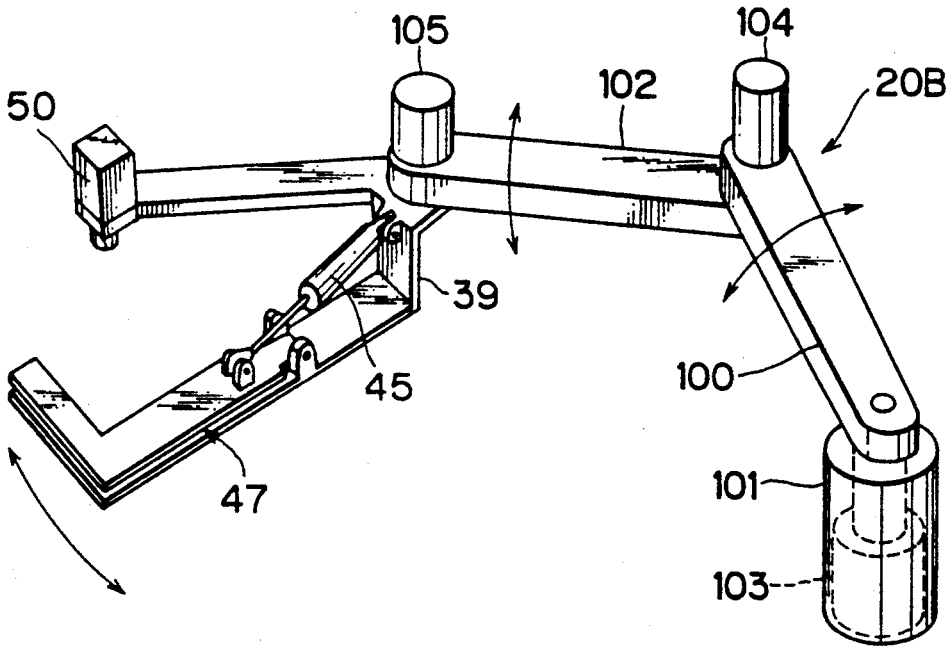
FIG. 31 is a perspective view of a modified fabric position correcting device.

The method of the present invention may be carried out using a position correcting device 20B as shown in FIG. 31. A first swing arm 100 has a proximal end horizontally angularly movably mounted on a support member 101 fixed to a machine frame (not shown). A second swing arm 102 has a proximal end horizontally angularly movably mounted on the distal end of the first swing arm 100. A first turn arm 39, which is identical to the first turn arm 39 in the previous embodiment, is horizontally angularly movably mounted at its proximal end on the distal end of the second swing arm 102. The support member 101 supports a first turn motor 103 which comprises a stepping motor for turning the first swing arm 100. A second turn motor 104 for turning the second swing arm 102 is mounted on the distal end of the first swing arm 100, and a third turn motor 105 for turning the first turn arm 39 is mounted on the distal end of the second swing arm 102.

A first air cylinder 45 and a first holder 47 are mounted on the first turn arm 39. As with the previous embodiment, an error angle and an error distance from a preset position are calculated based on image data from an image sensor 50 which images a corner of a fabric W1, depending on the control process selected by the selector switch 62, and the first, second, and third turn motors 103, 104, 105 are energized based on the calculated error angle and error distance. This embodiment offers the same advantages as those of the previous embodiment.

While an exemplary embodiment of this invention has been described in detail, those skilled in the art will recognize that there are many possible modifications and variations which may be made in this exemplary embodiment while yet retaining many of the novel features and advantages of the invention. Accordingly, all such modifications and variations are intended to be included within the scope of the appended claims.

What is claimed is:

1. A method of positioning and feeding a fabric with pressing and feeding means for feeding a fabric, to a sewing machine having a bed, on a support base disposed at substantially the same level as the bed and upstream with respect to a direction in which the fabric is fed, while the fabric is being pressed against the support base with a plurality of independently actuatable pressers spaced at intervals in said direction, position detecting means, including imaging means for successively imaging a plurality of portions of the fabric which correspond to the pressers, for detecting the position of at least one of an outer profile line and a pattern of each of the portions of the fabric based on image data produced by said imaging means, and position correcting means for correcting the position of each of the portions of the fabric that have been detected, while the portions of the fabric are being successively held in position, said method comprising the steps of:

(a) detecting the position of each of the portions of the fabric corresponding to one of the pressers, with the position detecting means;

(b) correcting the position of a portion of the fabric while holding said portion, the position of which has been detected, with the position correcting means;

(c) pressing a portion of the fabric with one of the pressers after the position thereof has been corrected;

(d) repeating the steps (a), (b), and (c) successively with respect to other portions of the fabric; and (e) feeding the fabric to a sewing start position with the pressing and feeding means.

2. The method according to claim 1, further comprising the step of:

(f) sewing the fabric, and feeding the fabric with the pressing and feeding means in synchronism with feeding of the fabric in the sewing machine, as the fabric starts being sewn by the sewing machine.

3. The method according to claim 1, further comprising the step of:

(g) loading the fabric in a predetermined region on the support base prior to carrying out the step (a).

4. The method according to claim 3, wherein the step (g) comprises the steps of:

(h) moving the fabric toward the predetermined region;

(i) determining whether the fabric is loaded in the predetermined region based on image data produced by said imaging means;

(j) when it is determined in the step (i) that a portion of the fabric that is moved in the predetermined region is larger than a predetermined amount determined on the basis of the image data, completing loading of the fabric in the predetermined region; and (k) when it is determined in the step (i) that the portion of the fabric that is moved in the predetermined region is less than the predetermined amount, providing an alarm that the fabric is not sufficiently moved in the predetermined region.

5. The method according to claim 3, wherein the step (g) comprises the steps of:

(l) moving the fabric toward the predetermined region;

(m) determining whether the fabric is loaded in the predetermined region based on image data produced by said imaging means;

(n) when it is determined in the step (m) that the portion of the fabric that is moved in the predetermined region is larger than a first amount determined on the basis of the image data, completing loading of the fabric in the predetermined region; and (o) when it is determined in the step (m) that the portion of the fabric that is moved in the predetermined region is less than the first amount but larger than a second amount determined on the basis of the image data, further moving the fabric into the predetermined region; and (p) when it is determined in the step (m) that the portion of the fabric that is moved in the predetermined region is less than the second amount, providing an alarm that the fabric is not sufficiently moved in the predetermined region.

6. The method according to claim 5, further comprising the steps of:

(q) when it is determined that the portion of the fabric that is further moved in the step (o) is larger than the first amount, then completing the loading of the fabric in the predetermined region; and (r) when it is determined that the portion of the fabric that is further moved in the step (o) is less than the first amount, then providing an alarm that the fabric is not sufficiently moved in the predetermined region.

7. The method according to claim 5, further comprising the steps of:

(s) when it is determined that the portion of the fabric that is further moved in the step (o) is larger than the first amount, then completing the loading of the fabric in the predetermined region; and (t) when it is determined that the portion of the fabric that is further moved in the step (o) is less than the first amount, then still further moving the fabric in the predetermined region.

8. The method according to claim 1, further comprising the step of instructing one of processes selected from an outer profile line aligning process, a pattern aligning process, and outer profile line/pattern aligning process, prior to carrying out the step (a).

9. The method according to claim 8, wherein when the outer profile line aligning process is selected, the step (a) comprises the step of:

(u) detecting an outer profile line of the fabric based on image data produced from said imaging means.

10. The method according to claim 8, wherein when the pattern aligning process is selected, the step (a) comprises the step of:

(v) detecting a pattern of the fabric based on image data produced from said imaging means.

11. The method according to claim 8, wherein when the outer profile line/pattern aligning process is selected, the step (a) comprises the step of:

(w) detecting an outer profile line and a pattern of the fabric based on image data produced from said imaging means.

* * * * *